US008556093B2

(12) United States Patent
Davis et al.

(10) Patent No.: US 8,556,093 B2
(45) Date of Patent: Oct. 15, 2013

(54) SUPPORTING CONSUMER PRODUCTS

(75) Inventors: Raymond E. Davis, Heath, TX (US); Clifton Glenn Hampton, Burleson, TX (US)

(73) Assignee: ADCO Industries—Technologies, L.P., Dallas, TX (US)

( * ) Notice: Subject to any disclaimer, the term of this patent is extended or adjusted under 35 U.S.C. 154(b) by 1012 days.

(21) Appl. No.: 12/031,471

(22) Filed: Feb. 14, 2008

(65) Prior Publication Data

US 2008/0251483 A1 Oct. 16, 2008

Related U.S. Application Data

(60) Provisional application No. 60/911,995, filed on Apr. 16, 2007.

(51) Int. Cl.
*A47B 43/00* (2006.01)

(52) U.S. Cl.
USPC ..... 211/187; 211/175

(58) Field of Classification Search
USPC ..... 211/187, 175; 312/408, 306, 312; 108/108, 147.17, 141
See application file for complete search history.

(56) References Cited

U.S. PATENT DOCUMENTS 984,857 A * 2/1911 Schuftan ..... 108/106
1,699,710 A * 1/1929 Pearlman ..... 108/23
2,555,254 A * 5/1951 Stebbins ..... 312/319.7
2,841,459 A * 7/1958 Sharpe ..... 312/306
3,080,980 A 3/1963 Gibbons
3,151,576 A 10/1964 Patterson
3,172,715 A * 3/1965 Powder ..... 312/298
3,316,044 A * 4/1967 Carbary ..... 312/408
3,337,283 A * 8/1967 Schlenkert ..... 312/306

(Continued)

FOREIGN PATENT DOCUMENTS

DE 3925676 2/1991
EP 0438180 7/1991

(Continued)

OTHER PUBLICATIONS

Powershelf™ Product Comparison Guide, "*Evaluation: Present Shelving Systems* vs. *Power Shelf™ System Solution*,"[online],<http://www.adcoindustries.com/Powershelf%20PDFhtm>, retrieved Feb. 8, 2008, 2 pages.

(Continued)

*Primary Examiner* — Darnell Jayne
*Assistant Examiner* — Patrick Hawn
(74) *Attorney, Agent, or Firm* — Fish & Richardson P.C.

(57) ABSTRACT

A device for supporting consumer products includes a transmission, a first end plate, a second end plate, and a shelf. The transmission includes a worm wheel coupled to a socket; a worm gear engaged to the worm wheel and coupled to a back axle shaft; a first pinion gear coupled to a first end of the back axle shaft; and a second pinion gear coupled to a second end of the back axle shaft. The first end plate is coupled to a first end of a back axle shaft shroud, where the back axle shaft shroud includes a first shelf hook and a second shelf hook. The second end plate coupled to the second end of the back axle shaft. The shelf is coupled to the first and second end plates and includes a first and a second shelf pin.

16 Claims, 25 Drawing Sheets

(56) References Cited

U.S. PATENT DOCUMENTS

| | | | | | |
|---|---|---|---|---|---|
| 3,570,798 | A | | 3/1971 | Squibb | |
| 3,967,734 | A | | 7/1976 | Morgan et al. | |
| 3,982,801 | A | * | 9/1976 | Heidorn et al. | 312/306 |
| 4,026,222 | A | * | 5/1977 | Mueller | 108/146 |
| 4,098,480 | A | | 7/1978 | Neumann | |
| 4,169,416 | A | | 10/1979 | Haynes et al. | |
| 4,217,010 | A | * | 8/1980 | Webb | 312/407 |
| 4,221,443 | A | * | 9/1980 | Heaney | 312/306 |
| 4,275,665 | A | | 6/1981 | Silverman | |
| 4,329,928 | A | * | 5/1982 | Shaw | 108/106 |
| 4,519,508 | A | | 5/1985 | Gullett et al. | |
| 4,593,823 | A | | 6/1986 | Fershko et al. | |
| 4,730,738 | A | * | 3/1988 | Bartus et al. | 211/90.02 |
| 4,880,285 | A | | 11/1989 | Brinkers | |
| 5,117,986 | A | * | 6/1992 | Lin | 211/90.02 |
| 5,119,944 | A | | 6/1992 | Milton | |
| 5,199,778 | A | * | 4/1993 | Aoki et al. | 312/408 |
| 5,249,858 | A | | 10/1993 | Nusser | |
| 5,333,746 | A | | 8/1994 | Bustos | |
| 5,490,600 | A | | 2/1996 | Bustos | |
| 5,577,623 | A | | 11/1996 | Bustos | |
| 5,607,068 | A | | 3/1997 | Coretti et al. | |
| 5,645,182 | A | | 7/1997 | Miller, Jr. et al. | |
| 5,695,075 | A | | 12/1997 | Flum et al. | |
| 5,706,956 | A | | 1/1998 | Headrick et al. | |
| 5,738,019 | A | | 4/1998 | Parker | |
| 5,765,702 | A | | 6/1998 | Bustos et al. | |
| 5,799,588 | A | * | 9/1998 | Engel | 108/108 |
| 5,806,689 | A | | 9/1998 | Mays et al. | |
| 5,913,584 | A | | 6/1999 | Swindell et al. | |
| 6,021,908 | A | | 2/2000 | Mathews | |
| 6,024,025 | A | * | 2/2000 | Koch et al. | 108/147 |
| 6,044,983 | A | | 4/2000 | Hall | |
| 6,065,821 | A | * | 5/2000 | Anderson et al. | 312/408 |
| 6,132,158 | A | | 10/2000 | Pfeiffer et al. | |
| 6,158,600 | A | | 12/2000 | Ferrucci et al. | |
| 6,234,328 | B1 | * | 5/2001 | Mason | 211/90.02 |
| 6,302,282 | B1 | * | 10/2001 | Gay et al. | 211/153 |
| 6,332,547 | B1 | | 12/2001 | Shaw et al. | |
| 6,431,378 | B1 | | 8/2002 | Lewis | |
| 6,443,319 | B1 | | 9/2002 | Sander | |
| 6,505,900 | B2 | * | 1/2003 | Frederick | 312/319.7 |
| 6,726,039 | B2 | | 4/2004 | Boron | |
| 6,843,382 | B2 | | 1/2005 | Kanouchi et al. | |
| 6,962,116 | B2 | * | 11/2005 | Bienick et al. | 108/108 |
| 6,978,906 | B2 | | 12/2005 | Wishart et al. | |
| 7,128,221 | B2 | | 10/2006 | Metcalf | |
| 7,175,034 | B2 | | 2/2007 | Nook et al. | |
| 7,178,890 | B2 | * | 2/2007 | Park et al. | 312/408 |
| 7,198,160 | B2 | | 4/2007 | Ernst et al. | |
| 7,246,711 | B1 | | 7/2007 | Metcalf | |
| 7,260,438 | B2 | * | 8/2007 | Caldwell et al. | 700/60 |
| 7,306,303 | B2 | * | 12/2007 | Ritchie et al. | 312/408 |
| 7,311,211 | B2 | | 12/2007 | Chung | |
| 7,337,730 | B2 | * | 3/2008 | Bienick et al. | 108/108 |
| 7,533,948 | B2 | | 5/2009 | Smith et al. | |
| 7,611,111 | B2 | * | 11/2009 | Costa et al. | 248/243 |
| 2003/0173320 | A1 | | 9/2003 | Linney, II et al. | |
| 2004/0245199 | A1 | | 12/2004 | Chen | |
| 2005/0000924 | A1 | | 1/2005 | Webb | |
| 2005/0092701 | A1 | | 5/2005 | Metcalf | |
| 2005/0127017 | A1 | * | 6/2005 | Kessel et al. | 211/187 |
| 2006/0076303 | A1 | | 4/2006 | Scholen et al. | |
| 2007/0012640 | A1 | | 1/2007 | Scholen et al. | |
| 2007/0068885 | A1 | | 3/2007 | Busto et al. | |
| 2007/0080123 | A1 | | 4/2007 | Mason | |
| 2007/0125727 | A1 | | 6/2007 | Winkler | |
| 2007/0193971 | A1 | | 8/2007 | Hardy et al. | |
| 2007/0295681 | A1 | | 12/2007 | Colin | |
| 2008/0048081 | A1 | * | 2/2008 | Costa et al. | 248/241 |
| 2008/0061015 | A1 | | 3/2008 | Hardy et al. | |
| 2008/0116156 | A1 | | 5/2008 | Park | |
| 2008/0251483 | A1 | | 10/2008 | Davis et al. | |

FOREIGN PATENT DOCUMENTS

| | | |
|---|---|---|
| EP | 0919165 | 6/1999 |
| JP | 06034265 | 2/1994 |
| WO | 2006/096353 | 9/2006 |

OTHER PUBLICATIONS

ADCO Industries, "*Storage Shelving—For Coolers, Backroom Dry Storage and Off-the-Floor Shelving*," [online], <http://www.adcoindustries.com/shelving.htm>, retrieved Feb. 8, 2008, 1 page.

ADCO Industries, "*Beverage Cooler Management Products*," [online], <http://www.adcoindustries.com/cooler.htm>, retrieved Feb. 8, 2008, 1 page.

The Guide to Successful Beverage Cooler Management, "*A Comprehensive Management Program for Beverage Coolers Using the Mini Mule Dolly System*." [online], <http://www.adcoindustries.com/MULEBROC.pdf>,retrieved Feb. 8, 2008, 15 pages.

Welcome to Display Technologies, "*Partners in Innovation—Optimizers*," [online], <http://www.display-technologies.com/products/techstoc_flooroptim.html>, retrieved Feb. 8, 2008, 2 pages.

Welcome to Display Technologies, "*Partners in Innovation—Home—Custom Products—Keebler Company*," [online], <http://www.display-technologies.com/products/custom/prod_keebler.html>, retrieved Feb. 13, 2008, 3 pages.

Search Report issued in corresponding European Patent Application No. 08153842.3 dated Aug. 6, 2008; 6 pages.

Search Report issued in related European Patent Application No. 08153836.5 dated Aug. 12, 2008; 7 pages.

Office Action dated Dec. 8, 2010 for U.S. Appl. No. 12/031,482 "Supporting Consumer Products" by Raymond E. Davis et al., 13 pages.

EP Office Action ; Cardan; Jul. 18, 2012; European Patent Office (EPO); 08153842.3; 4 pages.

USPTO Non-Final Office Action; PUROL; Apr. 25, 2011; U.S. Appl. No. 12/031,482; 7 pages.

EP Office Action; Cardan, Cosmin; Jan. 3, 2013; European Patent Office (EPO); 08153842.3; 4 pages.

* cited by examiner

SUPPORTING CONSUMER PRODUCTS

CLAIM OF PRIORITY

This application claims priority under 35 U.S.C. §119(e) to U.S. Provisional Patent Application Ser. No. 60/911,995, filed on Apr. 16, 2007, the entire contents of which are hereby incorporated by reference.

TECHNICAL BACKGROUND

This disclosure relates to supporting consumer products for display and storage, and more particularly, to supporting consumer products on adjustable and mobile shelves within a self-supporting frame system for use in, for example, a walk-in cooler or other display area.

BACKGROUND

Storage and display of consumer products may be accomplished by a variety of different devices, structures, and methods. In particular, the storage and display of food products and beverages may typically utilize a shelving system consisting of a frame and one or more shelves connected to the frame. The frame, generally, may include four vertical legs, which allow each shelf to be attached to the legs at each corner of the shelf. In such a fashion, many product shelving systems may rely almost exclusively on the connection of the shelves to the vertical legs to allow the entire structure to stand upright and support the product. Often, for heavier product to be supported by the shelving system, more shelves must be included within the system to provide additional structural stability.

Consumer products, such as food and beverage containers, also come in many different sizes and configurations. For example, although particular beverage containers, such as, for example, aluminum cans, are substantially similar in certain dimensions (e.g., diameter), different brands or drink-types may come in containers of varying height. Often, a shelving system designed to support various types of containers may be able to change a distance between shelves to account for the height difference in the containers. In order to change this distance, however, product may need to be removed from the particular shelf or shelves before such a change may take place. Moreover, depending on the number of shelves to be changed and the degree to which such shelves support the shelving system frame, an amount of time and labor required to effect such a change may be great.

In the case of food and beverage containers, such containers often break or leak the food substance onto the shelving system on which they are supported. Because cleanliness in the storage and display of food and beverages may be of particular concern for certain businesses, such as grocery stores and convenience stores, broken or leaking food and beverage containers may cause problems for a particular shelving system. For instance, various shelving systems may be particularly immobile when supporting a capacity of food and beverage product. Thus, food and beverage substances that leak onto a floor below the shelving system may be particularly difficult to remove. In such cases, removal of the entire capacity of food product or even disassembly of the shelving system may be required in order to sanitize the floor.

SUMMARY

This disclosure relates to supporting consumer products for display and storage, and more particularly, to supporting consumer products on adjustable and mobile shelves within a self-supporting frame system for use in, for example, a walk-in cooler or other display area.

In one general aspect, a system for supporting consumer products includes a self-supporting frame and at least one adjustable shelf disposed within the frame. The adjustable shelf is adapted to vertically traverse the frame using a single point of control through substantially infinite increments between a first end of the frame and a second end of the frame without unloading one or more consumer products from the shelf. In more particular aspects, the adjustable shelf may be disposed within the frame at an adjustable angle from substantially downward vertical. Further, the single point of control may include a ratchet. The adjustable shelf may be a cantilevered adjustable shelf.

In another general aspect, a system for supporting consume products includes a first self-supporting frame; a second self-supporting frame adjacent the first self-supporting frame, where the second self-supporting frame and the first self-supporting frame share at least one substantially vertical support member; a first adjustable shelf disposed within the first self-supporting frame; and a second adjustable shelf disposed within the second self-supporting frame. The first adjustable shelf is adapted to vertically traverse the first frame in contact with the substantially vertical support member through substantially infinite intermediate positions between a first end of the first frame and a second end of the first frame. The second adjustable shelf is adapted to vertically traverse the second frame in contact with the substantially vertical support member independent of the first adjustable shelf through substantially infinite intermediate positions between a first end of the second frame and a second end of the second frame. In certain specific implementations, the first adjustable shelf is adapted to vertically traverse the first frame in contact with the substantially vertical support member through substantially infinite intermediate positions between a first end of the first frame and a second end of the first frame without unloading one or more consumer products from the first adjustable shelf.

In another general aspect, a device for supporting consumer products includes a transmission, a first end plate, a second end plate, and a shelf. The transmission includes a worm wheel coupled to a socket; a worm gear engaged to the worm wheel and coupled to a back axle shaft; a first pinion gear coupled to a first end of the back axle shaft; and a second pinion gear coupled to a second end of the back axle shaft. The first end plate is coupled to a back axle shaft shroud and includes a first shelf hook. The second end plate is coupled to the back axle shaft shroud and includes a second shelf hook. The shelf is coupled to the first and second end plates and includes a first and a second shelf pin. The first shelf pin is engageable with the first shelf hook and the second shelf pin is engageable with the second shelf hook.

In some aspects, the first pinion gear may be adapted to engage a first vertical rack gear and the second pinion gear may be adapted to engage a second vertical rack gear. One of the first vertical rack gear or the second vertical rack gear may be coupled to a vertical support member. The device may also include a slide bearing coupled to the first end plate, where the slide bearing consists of a grooved edge and a chamfered edge. The vertical support member may include a vertical rib, where the grooved edge of the slide bearing may be rotatably engageable with the vertical rib.

In more specific implementations, the shelf further may include at least one mounting pin and the first end plate may further include a first aperture and a second aperture. The mounting pin may be engageable in the first aperture at a first shelf angle and the mounting pin may be engageable in the second aperture at a second shelf angle. The first shelf angle may be an angle of a topside of the shelf of approximately 90 degrees from substantially vertical. In certain aspects, the second shelf angle may be an angle of the topside of the shelf of approximately 85 degrees from substantially vertical. In particular aspects, the second shelf angle may be an angle of the topside of the shelf of approximately 80 degrees from substantially vertical. In some implementations, the second shelf angle may be an angle of the topside of the shelf of approximately 75 degrees from substantially vertical. The shelf may also include a locking pin adapted to secure the mounting pin into the first aperture. In certain aspects, the shelf may be a wire shelf with a label display strip.

In some aspects, the worm gear may be a worm gear with a ratio between and including about 3:1 to about 10:1. The worm gear may also be a self-locking worm gear. Also, the shelf may be adapted to support a maximum load of approximately 200 pounds, where the worm gear is adapted to maintain the first and second pinion gears engaged with the first and second vertical rack gears at a static position at the maximum load.

In more particular aspects, the device may further include a front axle shaft coupled to the worm gear through a transmission shaft; a third pinion gear coupled to a first end of the front axle shaft and adapted to engage a third vertical rack gear; a fourth pinion gear coupled to a second end of the front axle shaft and adapted to engage a fourth vertical rack gear; a third end plate coupled to a front axle shaft shroud; and a fourth end plate coupled to the front axle shaft shroud.

In specific aspects, the shelf may include a front edge and a back edge, where the socket may be accessible through the shelf substantially proximate to the back edge. The device may further include a ratchet handle detachably coupled to the socket. In certain implementations, the transmission may be adapted to fail at a first load. The device may further include a safety extension detachably coupled to the socket. The safety extension includes a stem; a detent coupled to the stem and adapted to secure the stem within the socket; and a cap coupled to the stem and adapted to receive a ratchet drive. The cap includes a shear pin adapted to fail at a second load less than the first load.

In some aspects, the device may also consist of a pinion gear cover coupled to the first end plate by a spring loaded pull pin and adapted to pivotally shroud the first pinion gear. Additionally, the device may include a hook pin adapted to secure the first shelf pin engaged with the first shelf hook. In particular implementations, the shelf may be adapted to support consumer products located in a walk-in cooler or other display area.

In another general aspect, an adjustable shelving system for supporting consumer products includes a support frame; a first adjustable shelf assembly; and a second adjustable shelf assembly. The support frame includes a base structure; a first vertical support member coupled to the base structure including a first vertical rack gear; and a second vertical support member coupled to the base structure including a second vertical rack gear. Each of the first and second vertical rack gear includes a base end and a top end. The first adjustable shelf assembly includes a first transmission module coupled to the first and second vertical rack gears and adapted to traverse the first and second vertical rack gears; and a first shelf coupled to the first transmission module. The second adjustable shelf assembly includes a second transmission module coupled to the first and second vertical rack gears and adapted to traverse the first and second vertical rack gears independently of the first transmission module at all intermediate positions between the base ends and the top ends of the first and second vertical rack gears. The second adjustable shelf assembly also includes a second shelf coupled to the second transmission module. In some specific aspects, the second transmission module may be adapted to decouple from the first and second vertical rack gears independently of the first transmission module.

In certain specific aspects, the adjustable shelving system for supporting consumer products may include a third adjustable shelf assembly. The third adjustable shelf assembly may include a third transmission module and a third shelf coupled to the third transmission module. The third transmission module may be coupled to the second vertical rack gear, where the third transmission module is adapted to traverse the second vertical rack gear independently of the first and the second transmission modules at all intermediate positions between the base end and the top end of the second vertical rack gear.

Various implementations of a system for supporting consumer products according to the present disclosure may include one or more of the following features. For example, the system may include a frame structure that is self-supporting and may remain upright during product loading and removal. As another example, the system may include a substructure that minimizes product handling during product exchange and increases safety during a product loading process of the system. Also, the system may include a frame structure that allows a particular adjustable shelf to be installed or removed independently of other adjustable shelves within the system. As another example, the system may include a frame structure that remains decoupled from a walk-in cooler structure without loss of structural integrity. The system may also allow for a frame structure that may be adjustable for plumb at multiple points of the frame structure without removal of product. As another example, the system may include a frame structure that may provide a more sanitary food and beverage support system by allowing less food and beverage substance to become entrained in the frame structure. As an even further example, the system may include a frame structure and moveable product support shelf that allows a floor beneath the frame structure to achieve a higher degree of sanitation. The system may also allow consumer product to be supported and displayed at various gravity feed angles on a moveable support shelf. As another example, the system may allow for a moveable support shelf to lockably engage with a frame structure to allow for easier product removal and exchange independent of movement of the frame structure. As another example, the device or system may allow for multiple frame structures to share one or more vertical supports to more efficiently utilize floor space.

Various implementations of a device or a system for supporting consumer products according to the present disclosure may also include one or more of the following additional features. For example, the device or system may allow for a substantially infinitely adjustable shelf independently moveable and removable of other adjustable shelves. Also, the device or system may allow for an adjustable shelf to be vertically adjusted under load from a single point of adjustment. As another example, the device or system may utilize a single drive mechanism to adjust an adjustable shelf within a frame structure through substantially infinite increments. As yet another example, the device or system may utilize a worm gear mechanism to hold an adjustable shelf in a static position while under load. As an additional example, the device or system may allow for varying gravity feed angles of an adjustable shelf. As yet an additional example, the device or system may allow for a mobile, cantilevered shelf through a rack and pinion gear system. In addition, the device or system may allow an adjustable shelf to receive high loads by utilizing a rack and pinion gear system at each corner of the adjustable shelf with one point of adjustment control. Further, the device or system may at least partially prevent a catastrophic failure of a mobile shelf by engaging a frame structure and dispersing a friction of a load over a large contact area.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1A:
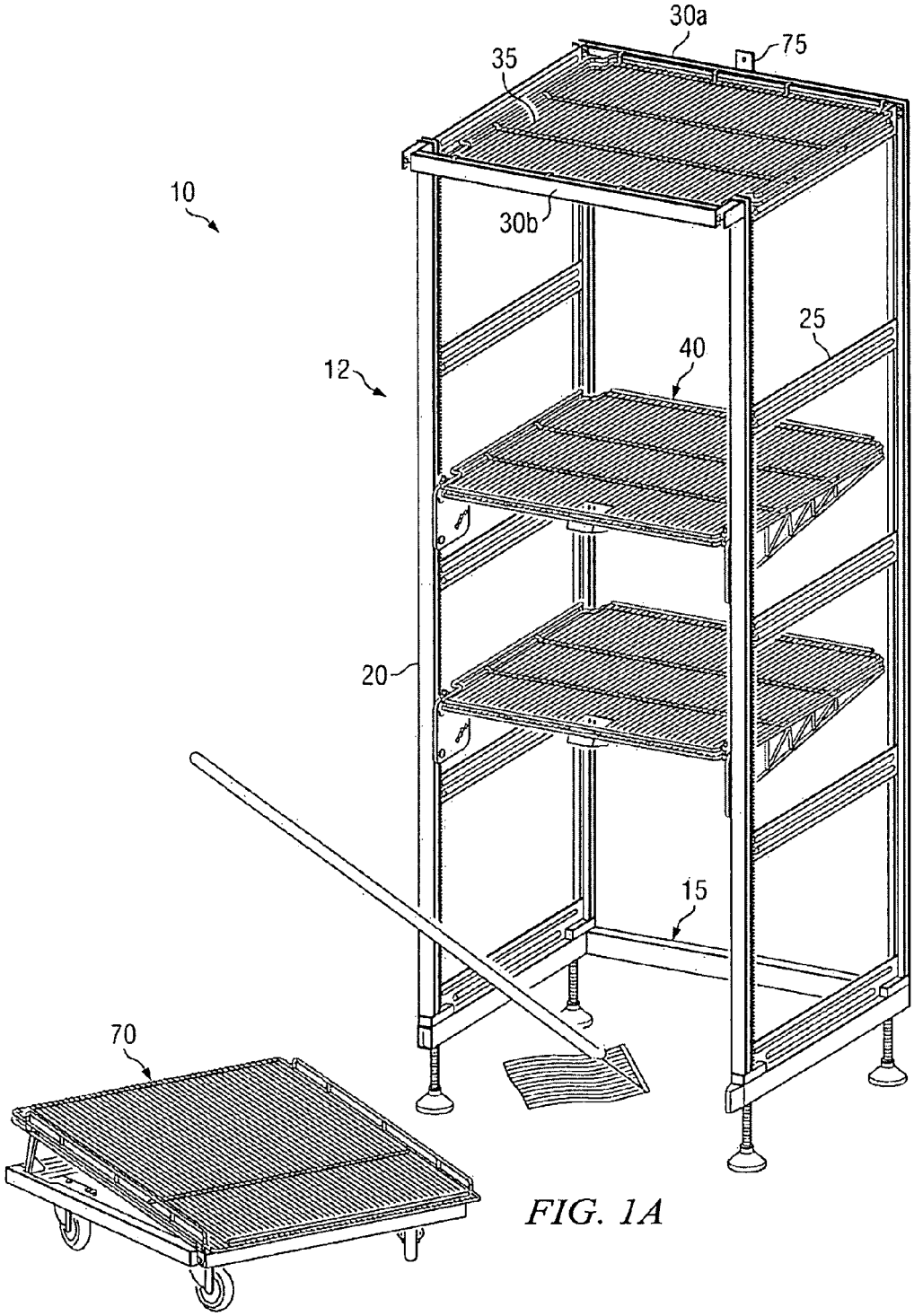
FIGS. 1A-B illustrate one implementation of a shelving system for supporting and displaying consumer products, including one or more adjustable shelves and a mobile support shelf.
Figure 1B:
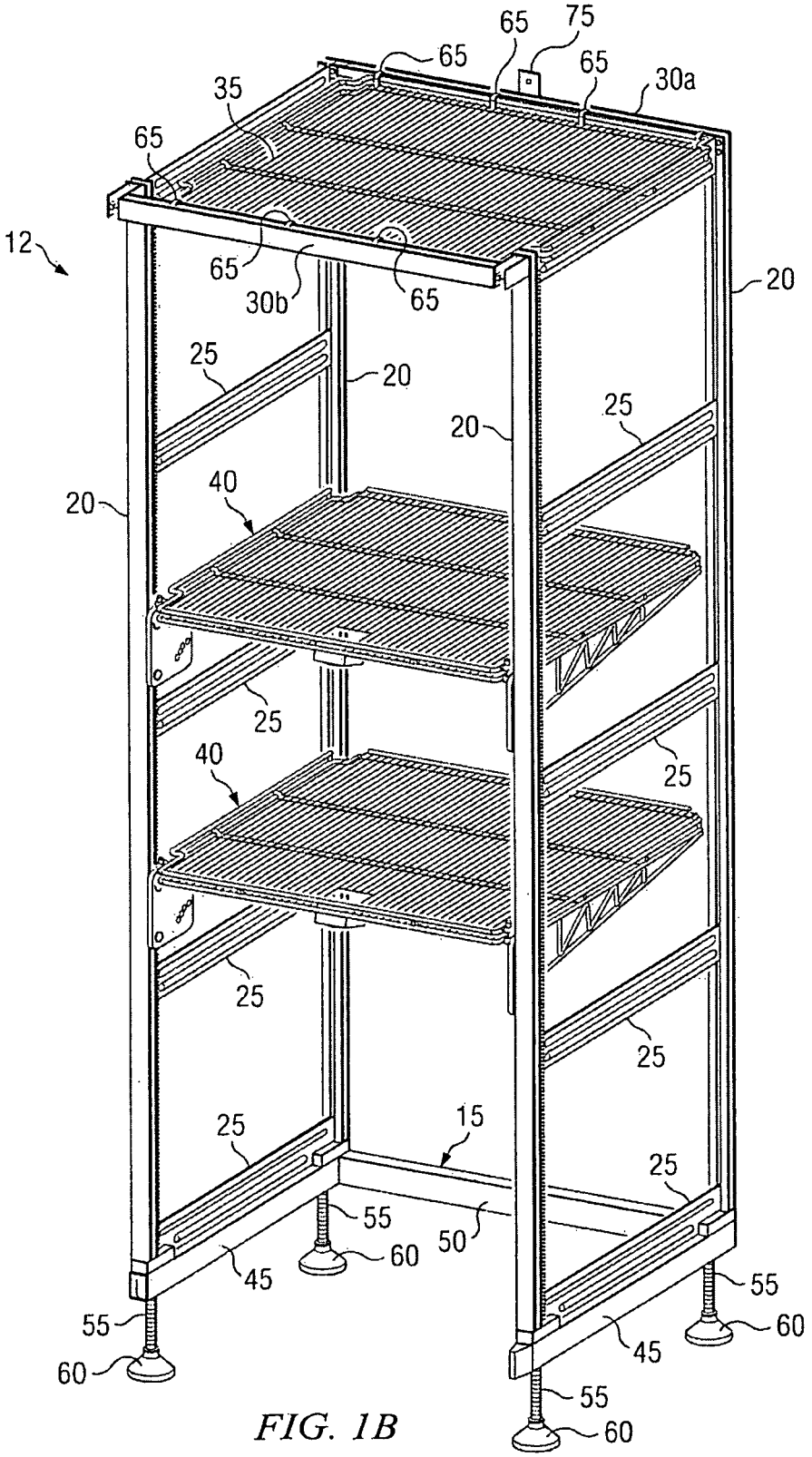

FIGS. 1A-B illustrate one implementation of a shelving system 10 for supporting and displaying consumer products, within, for example, a walk-in cooler or cooler vault. Shelving system 10 may include a frame 12 including a base structure 15; one or more vertical support members 20; one or more cross-members 25; a top structure including a front top member 30*a* and a back top member 30*b*; and a top shelf 35. The shelving system 10 may also include one or more adjustable shelves 40 and a docking shelf 70. Generally, the frame 12 is a self-supporting structure which relies on at least a portion of the base structure 15, vertical support members 20, and cross-members 25 to remain upright regardless of the inclusion of one or more adjustable shelves 40 within the frame 12 or attachment to a secondary structure. For instance, in some implementations, the frame 12 may be attached through a tab 75 to a secondary structure, such as a wall in a walk-in cooler, by any appropriate means of mechanical fastening. As illustrated in FIG. 1A, docking shelf 70 may be removed from the U-shaped pocket formed by the base structure 15 in order to, for example, sanitize a space beneath the base structure 15, add product to the docking shelf 70, or remove product from the docking shelf 70.

Turning particularly to FIG. 1B, the top shelf 35, in some aspects, may be a wire shelf, which, generally, may be attached to the top front member 30*a* and the top back member 30*b* through one or more shelf clips 65. In some aspects, the top shelf 35 is a substantially static "drop-in" shelf that provides additional structural support for the frame 12. For example, the top shelf 35 may help allow the frame 12 to remain in alignment under various loads. The base structure 15 includes one or more side base members 45, a front base member 50, and one or more support legs 55. In some aspects, the base structure 15 may also include one or more support feet 60 attached to the support legs 55. Generally, the base structure 15, as shown in FIGS. 1A-B, is a substantially U-shaped structure, which provides a substructure for the frame 12. Further, the base structure 15 provides for an enclosure in which the docking shelf 70 may be locked into place within the frame 12.

Figure 2A:
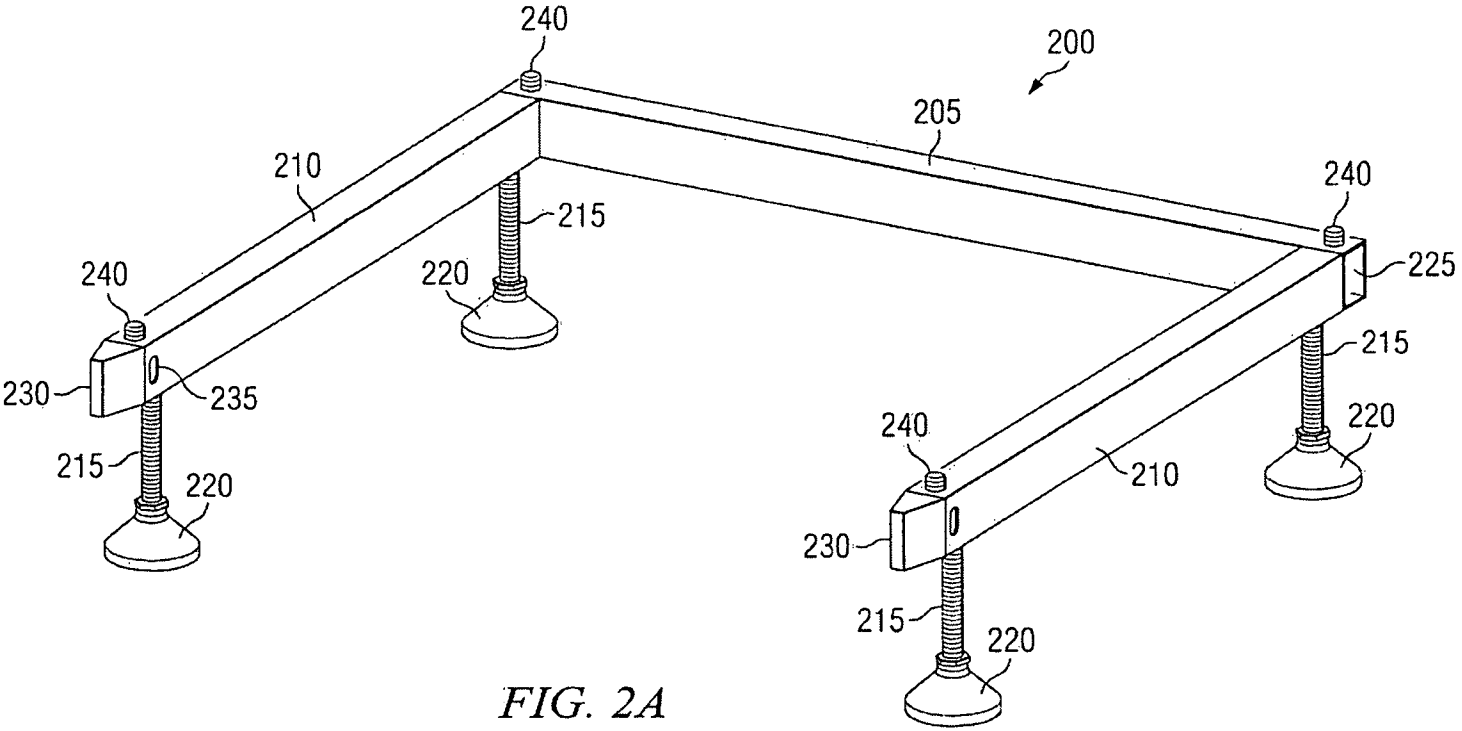
FIGS. 2A-B illustrate one implementation of a base structure for a shelving system according to certain aspects of the present disclosure.
Figure 2B:
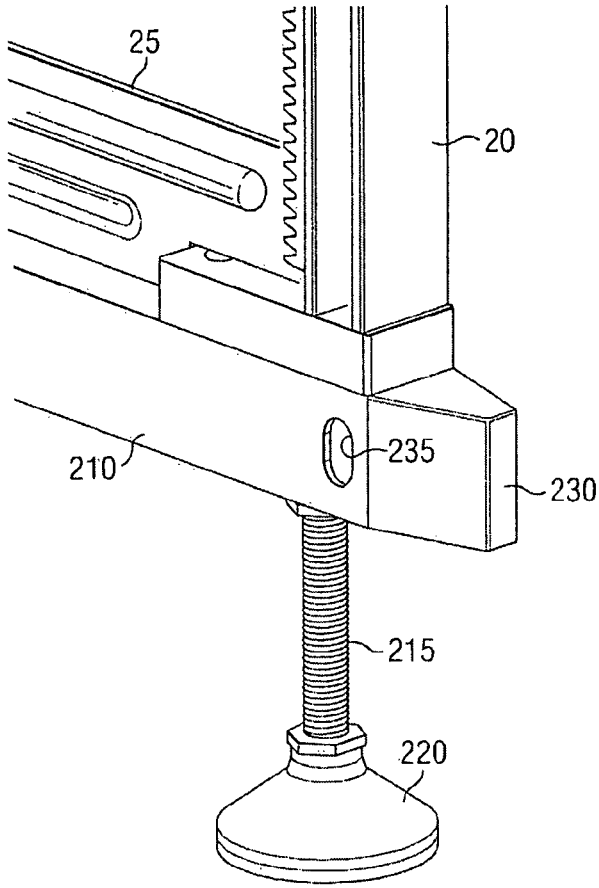

With reference to FIGS. 2A-B, one implementation of a U-base component 200 is shown in more detail. In some aspects, the U-base component 200 may be substantially similar to the base structure 15 described in FIGS. 1A-B. For example, U-base component 200 includes a front base member 205, two side base members 210, four support legs 215, four adjustable support feet 220, two guide plugs 230, and at least one slot 235. The front base member 205 and side base members 210 are, generally, tubular metal components welded or mechanically fastened together as shown. For example, in some aspects, the members 205 and 210 may be tubular aluminum components that are coated with a corrosion-resistant powder-coat epoxy. The members 205 and 210, however, may be any material of appropriate strength and corrosion resistance including, for example, stainless steel or painted ferrous steel, or titanium. The front base member 205 includes a base cavity 225 in one end of the member 205. As described later with reference to FIG. 3, the base cavity 225 may allow an additional base structure to be coupled to the U-base component 200. The base cavity 225 may be plugged during periods of non-use.

Guide plugs 230, typically, are formed plastic inserts into the side base members 210. The guide plugs 230 have a substantially triangular cross-section protruding outwardly from the side base members 210 and at least partially assist the docking shelf 70 to be inserted within the U-base component 200. Turning particularly to FIG. 2B, guide plug 230 is shown inserted into the substantially rectangular opening of side base member 210. The guide plug 230 may, in some aspects, partially compress a latch pin included on the docking shelf 70 (illustrated more fully in FIGS. 12A-C below). Once compressed, the latch pin may engage the slot 235 (i.e., extend into the slot 235) to lock the docking shelf into the U-base component 200.

The side base members 210 and front base member 205 each include a vertical aperture that may receive the support legs 215. In certain aspects, each support leg 215 consists of a threaded rod on which a support foot 220 may be connected. The support foot 220 may include an adjustable nut at the connection between the foot 220 and the support leg 215, which may allow the height of the side base members 210 and front base member 205 above a supporting surface to be adjusted. The U-base component 200 may thus be leveled plumb to account for variations in the surface as well as adjusted to account for a particular height preference of the U-base component 200.

Turning particularly to FIG. 2A, in some aspects the side base members 210 and front base member 205 may include one or more through bolts 240 vertically protruding from a top side of the U-base component 200, such as from the side base members 210 and the front base member 205. The through bolts 240, generally, are located at each corner of the U-base component 200 and may at least partially assist in aligning the vertical support members 20 for easier attachment to the U-base component 200.

Figure 3:
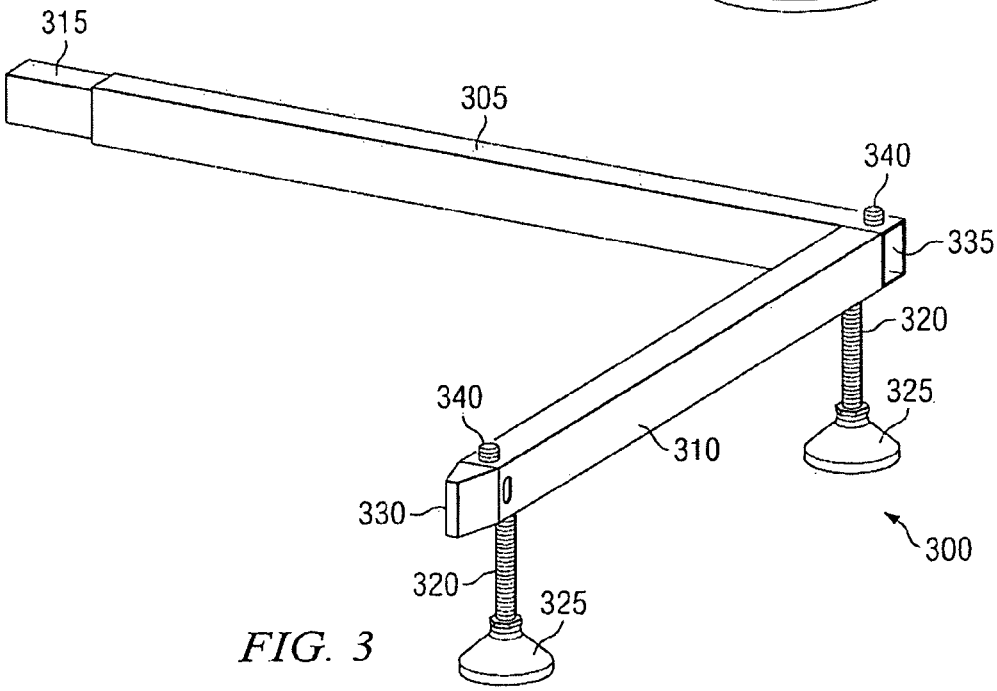
FIG. 3 illustrates another implementation of a base structure for a shelving system according to certain aspects of the present disclosure.

FIG. 3 illustrates another implementation of a base structure which may be used in a shelving system as described in the present disclosure. More specifically, FIG. 3 illustrates an L-base component 300 that may be coupled to, for example, the U-base component 200 illustrated in FIGS. 2A-B. Generally, the L-base component 300 may be coupled to the U-base component 200 or another L-base component 300 (along with corresponding vertical support members 20 and cross-members 25) in order to form a chain of shelving systems to support and display consumer products.

The L-base component 300 shown in FIG. 3 includes a front base member 305, a side base member 310, a protrusion 315, two or more support legs 320 with corresponding support feet 325, a guide plug 330, a base cavity 335, and one or more through bolts 340. The structure and function of the components of the L-base component 300 may be substantially similar to the corresponding components of the U-base component 200. Further, the protrusion 315 may be inserted into the base cavity 225 and secured in order to form two U-shaped enclosures sharing a common side base member 210. Additional L-base components 300 may also be connected by inserting and securing the base protrusion 315 from one L-base component 300 into the base cavity 335 of an adjacent L-base component. Successive base structures may thus share common side base members, as well as the corresponding vertical support members 20 attached to the common side base member.

Figure 4A:
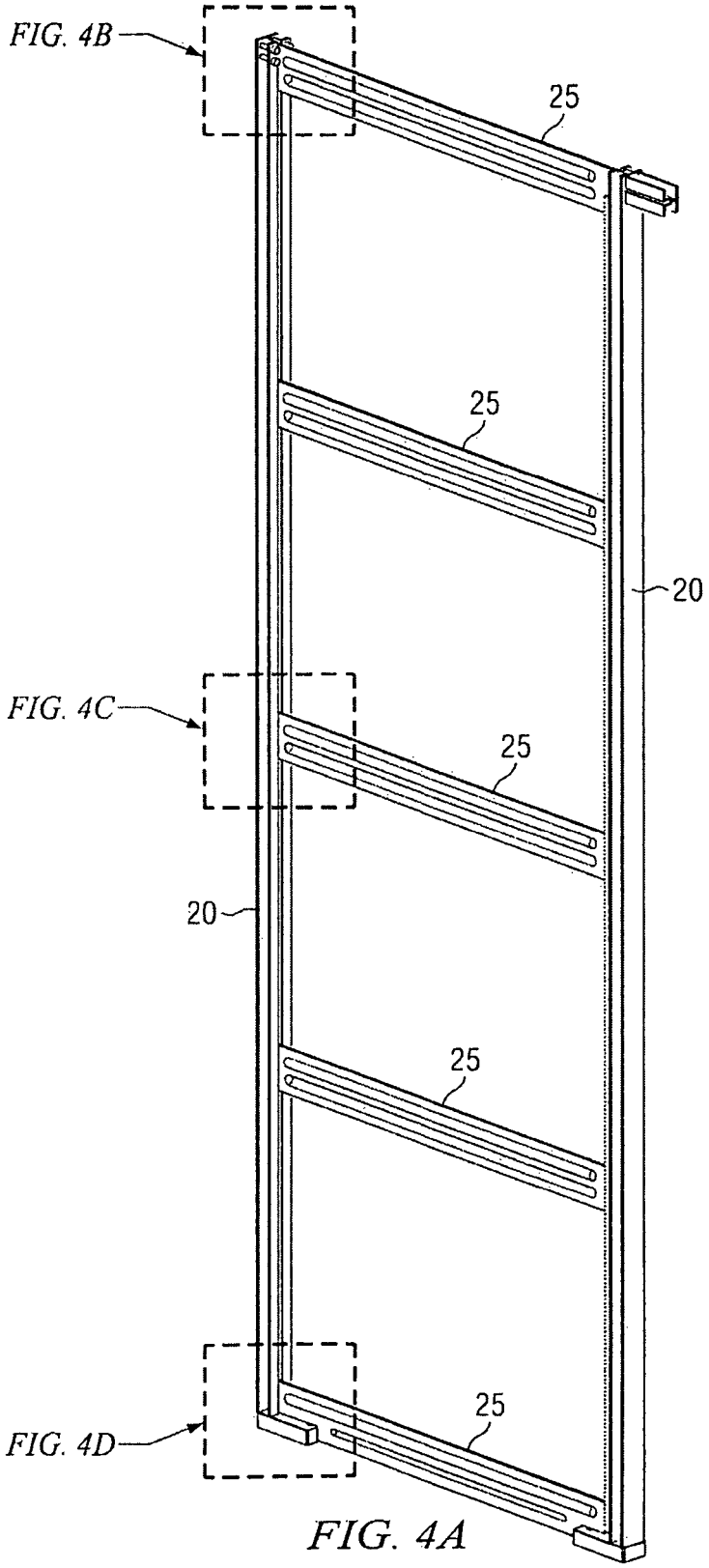
FIGS. 4A-D illustrate one view of a portion of a structural frame for a shelving system for supporting and displaying consumer products.
Figure 4B:
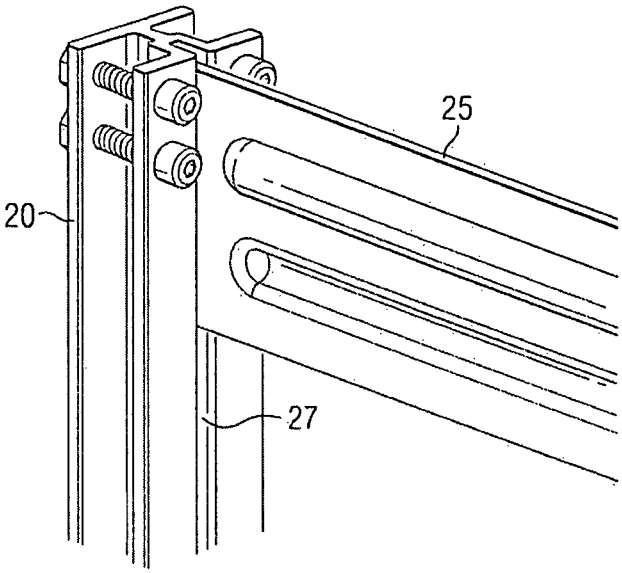
Figure 4C:
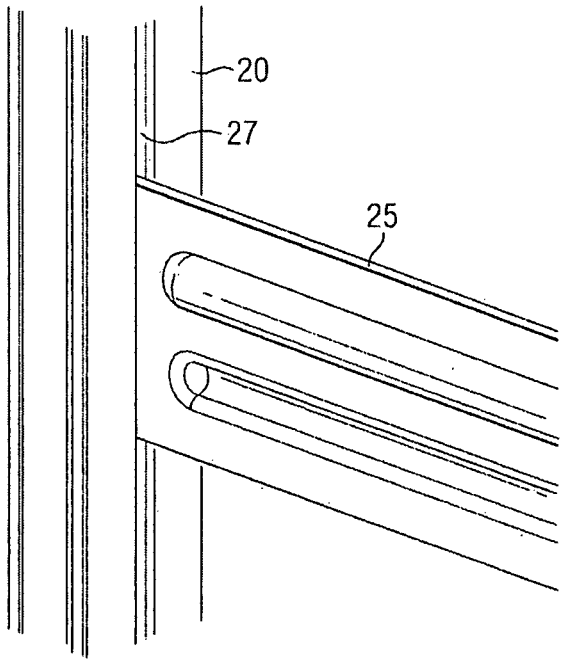
Figure 4D:
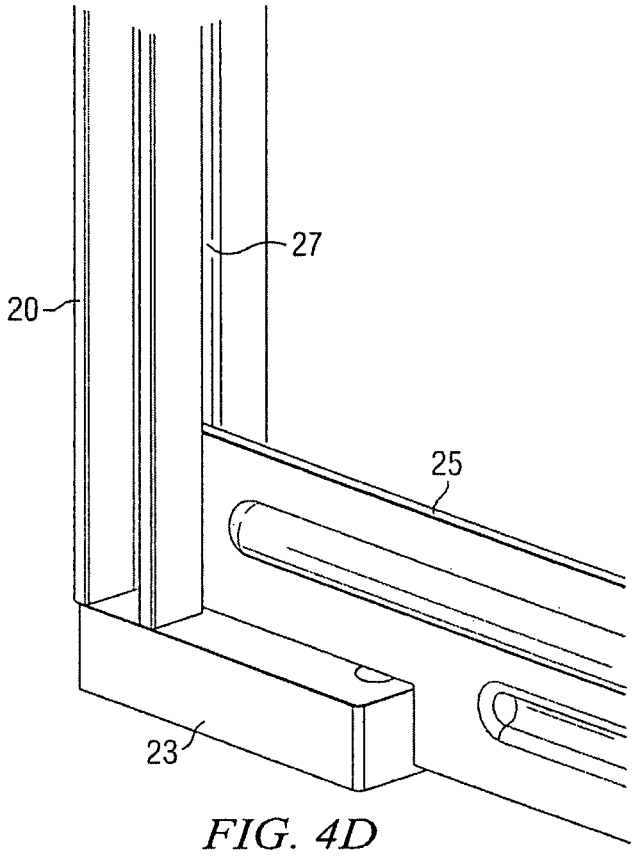

FIGS. 4A-D each illustrate one view of a portion of one implementation of the frame 12 for supporting and displaying consumer products. For example, FIGS. 4B-D may illustrate a view of cross-members 25 attached to a vertical support member 20 at the front of the frame 12 (i.e., coplanar with the front base member 50). Specifically, frame 12 includes several cross-members 25 attached between vertical support members 20 along each side of the frame 12. The cross-members 25 may be inserted and secured within a groove 27 of the vertical support member 20, as shown in FIGS. 4B-D. The cross-members 25 may be welded or otherwise mechanically fastened to the vertical support member 20 within the groove 27, as appropriate. A coupling member 23 may also be utilized in some aspects at the junction of the vertical support member 20, cross-member 25 and base structure 15 (not shown) illustrated in FIG. 4D. Vertical support members 20, typically, may be a modified I-beam member made of stainless steel, titanium, aluminum, or other appropriate material. In such aspects, the vertical support members 20 may offer few spaces and crevices for food and beverage products to become stuck in, thereby allowing for easier sanitation of the members 20 and less chance of bacteria forming on the structure.

Figure 5A:
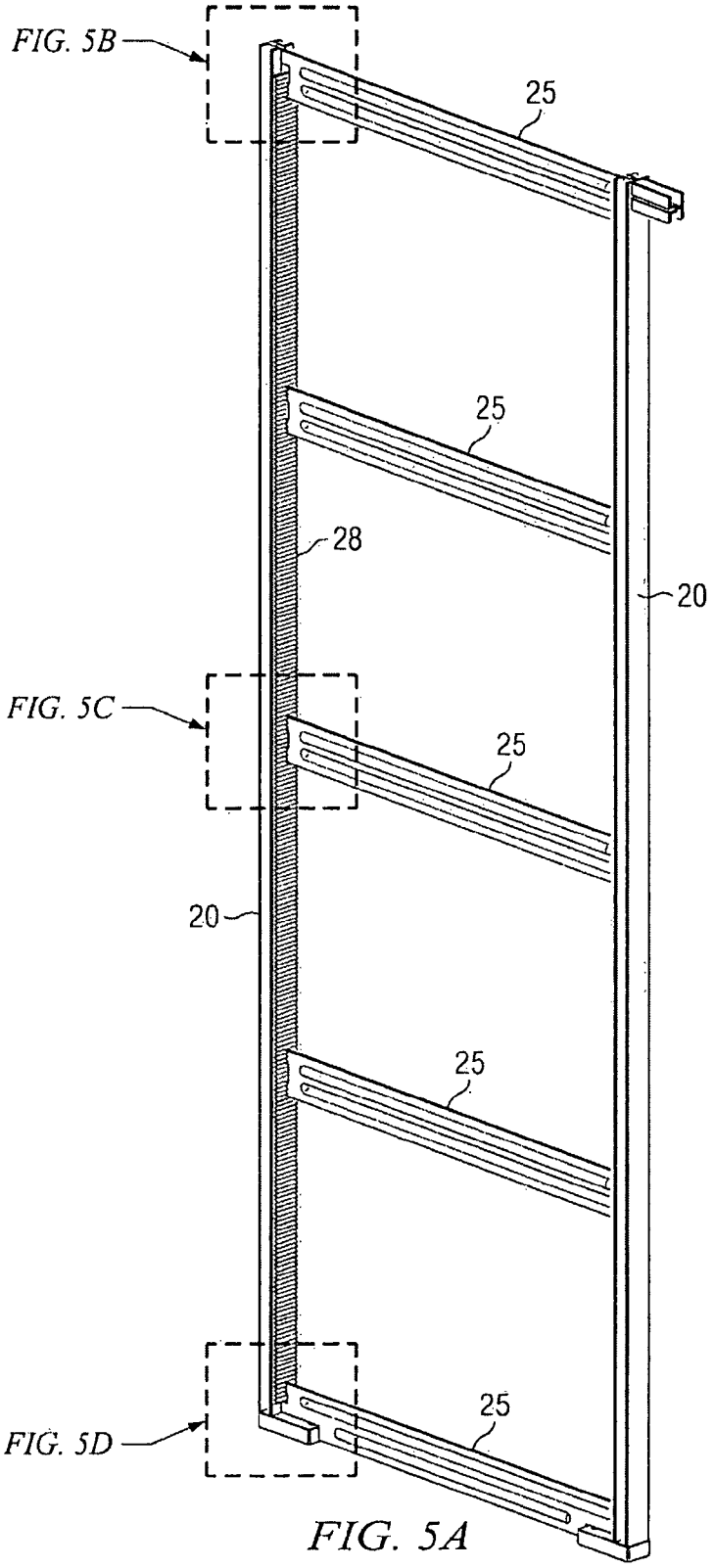
FIGS. 5A-D illustrate another view of a portion of a structural frame for a shelving system for supporting and displaying consumer products.
Figure 5B:
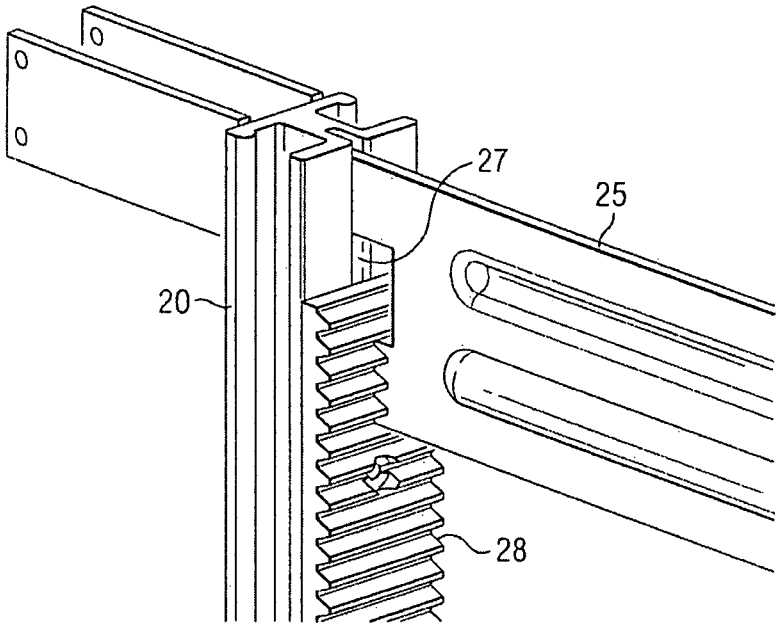
Figure 5C:
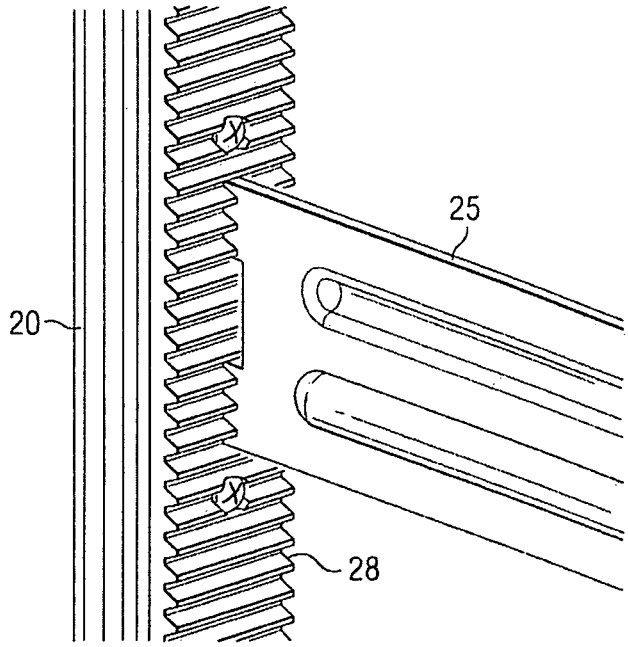
Figure 5D:
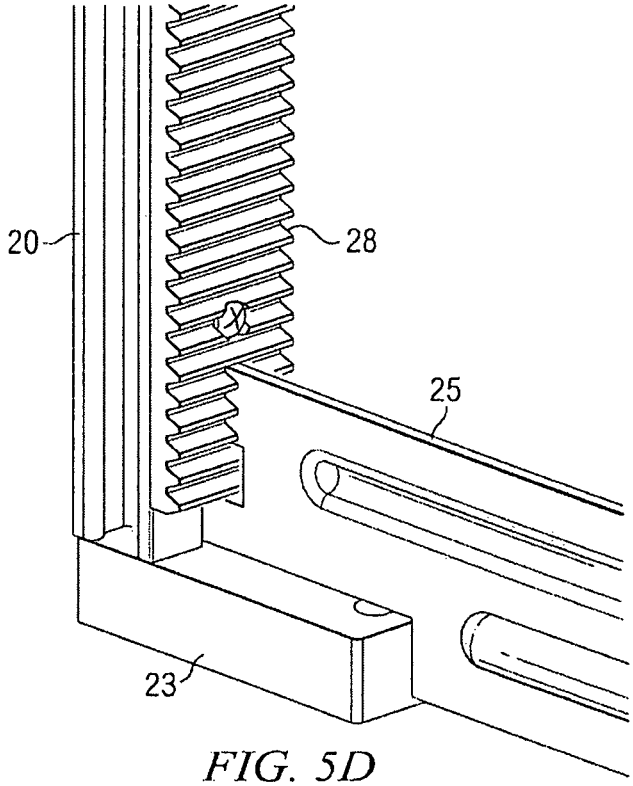

FIGS. 5A-D each illustrate one view of a portion of one implementation of the frame 12 for supporting and displaying consumer products. For example, FIGS. 5B-D may illustrate a view of cross-members 25 attached to a vertical support member 20 at the back of the frame 12 (i.e., at the opening of the U-shaped enclosure formed by the base structure 15). With particular reference to FIGS. 5B-D, the vertical support member 20 may be coupled to a vertical rack gear 28, which, generally, is fastened to the vertical support member 20 throughout the entire height of the member 20. The vertical rack gear 28, as described in more detail with reference to FIGS. 8A-B, may engage a pinion gear 660 on an adjustable shelf 600 to allow the adjustable shelf to traverse part or the entire distance of the vertical rack gear 28 and, therefore, part or the entire distance of the vertical support member 20. Cross-members 25 may include a specially formed end, as illustrated, to account for the teeth of the vertical rack gear 28. For example, a cross-member 25 located at the top of the frame 12 (shown in FIG. 5B) may include a flat portion to fit into a groove 27 and a portion to extend through vertical rack gear 28 and fit into groove 27. A cross-member 25 located at the bottom of the frame 12 (shown in FIG. 5D) may also include flat end portions to more closely couple through the vertical rack gear 28 and fit into groove 27. In some aspects, the vertical support members 20 located at the back of the frame 12 may include a graduated dimensional scale to visually indicate a specific height of each adjustable shelf 40 attached to the frame 12.

Figure 6A:
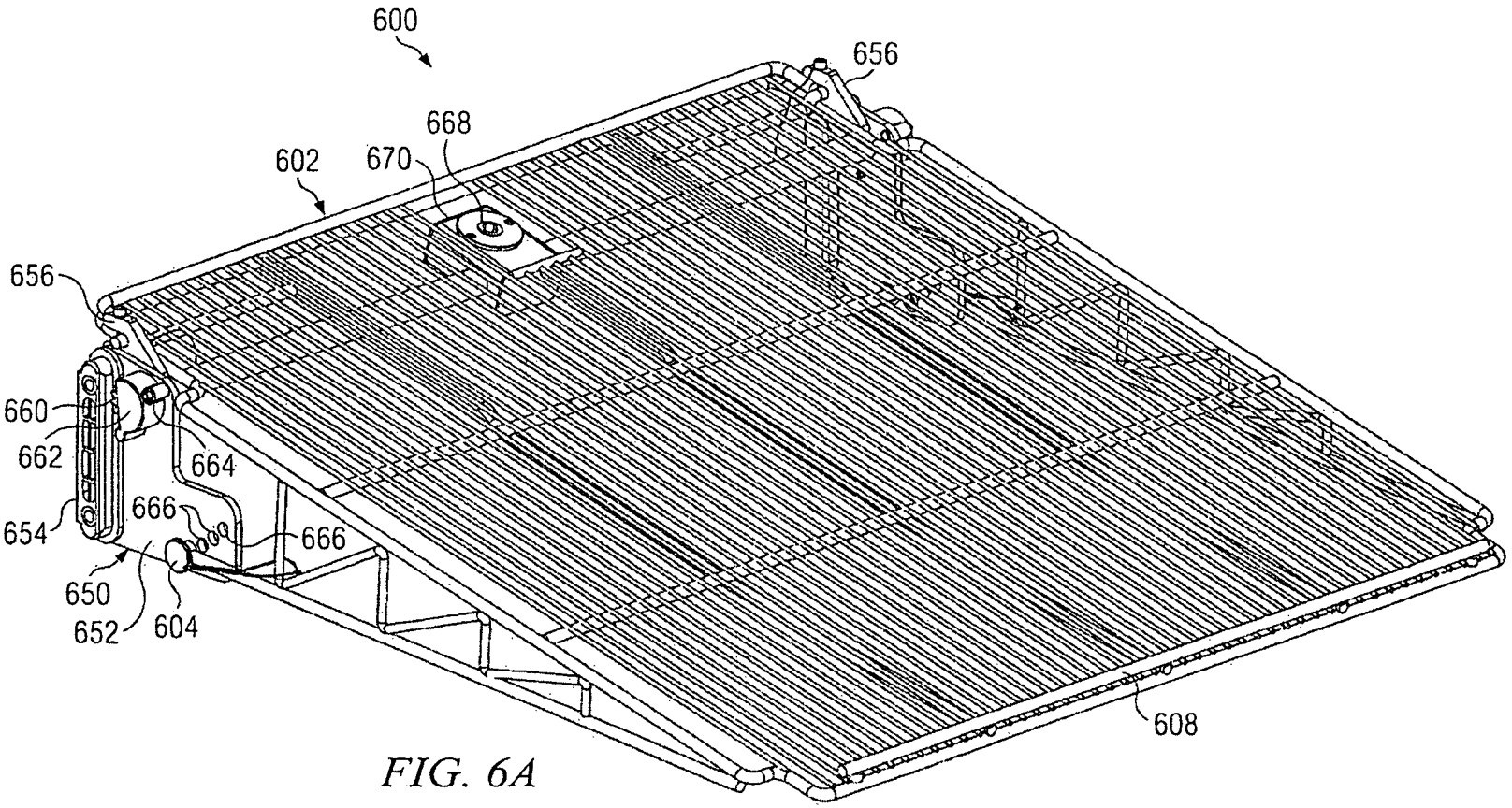
FIGS. 6A-C illustrate one implementation of an adjustable shelf for supporting and displaying consumer products.
Figure 6B:
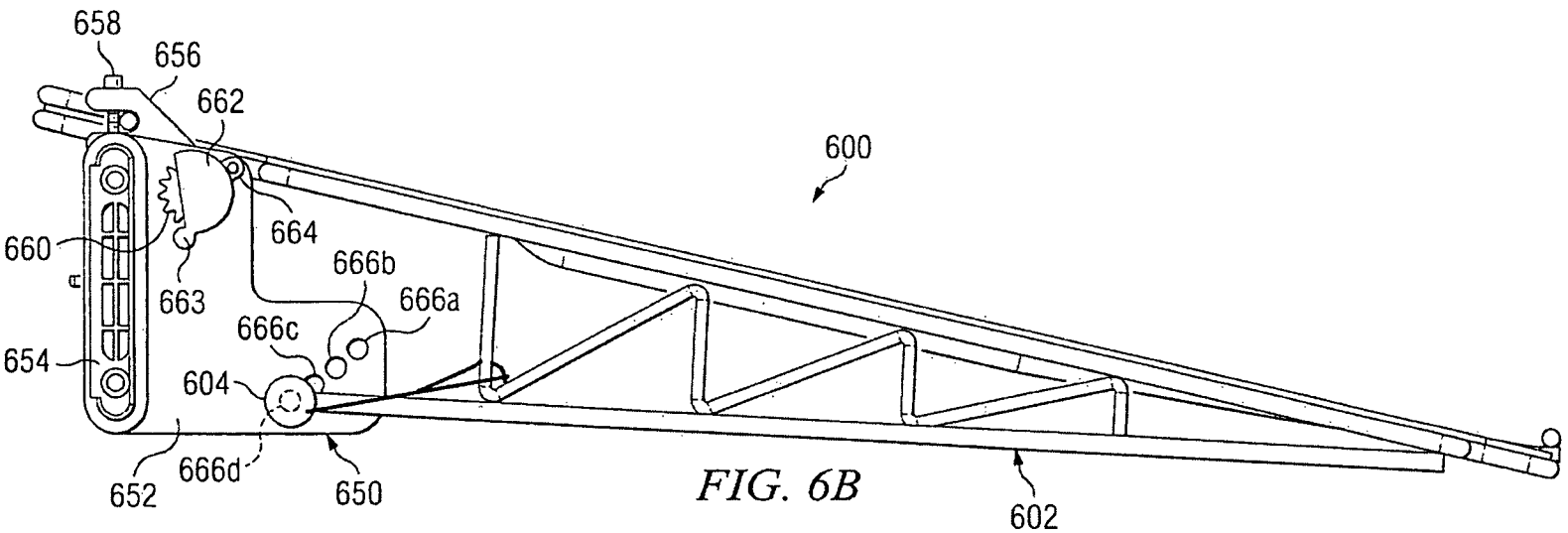
Figure 6C:
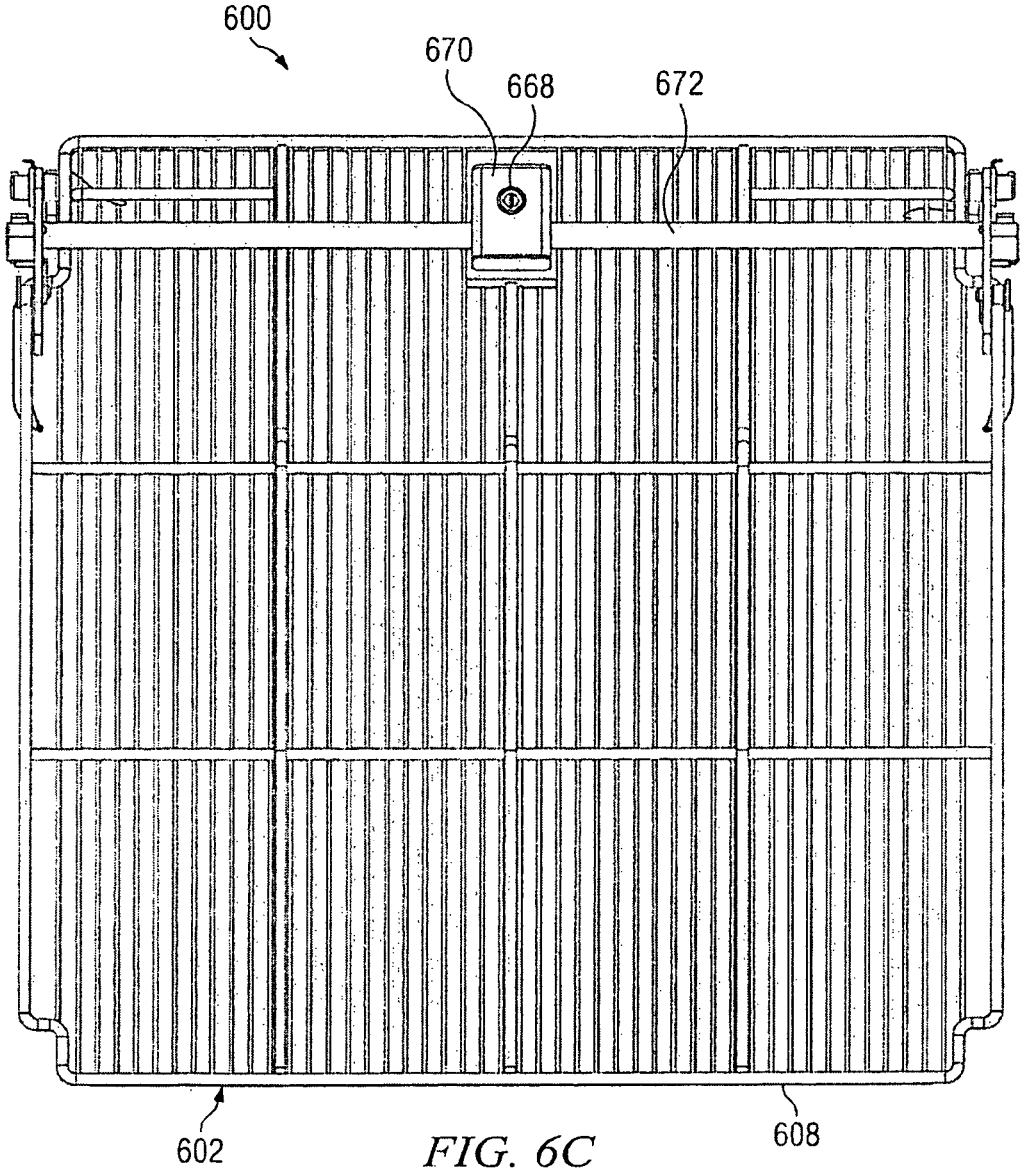

FIGS. 6A-C illustrate one implementation of an adjustable shelf 600 for supporting and displaying consumer products. Adjustable shelf 600 may be substantially similar to the adjustable shelf 40 illustrated as part of the shelving system 10 in FIGS. 1A-B. The adjustable shelf 600, shown in FIGS. 6A-C, includes a shelf 602 and a transmission 650. The shelf 602, in some aspects, is a wire shelf including a front bar 608. The front bar 608 may be utilized to prevent consumer products from sliding off the shelf 602, as well as to provide a place for a product display tag to be attached. Further, the front bar 608 may be used to attach a glide system (not shown) to the shelf 602, allowing consumer products to freely slide and stop at the front of the shelf 602.

Shelf 602 may be made of any appropriate rigid material, such as stainless steel, titanium, or aluminum, and may be coated with a rubber or plastic covering to facilitate easier cleaning and prevent corrosion. The shelf 602 is shown detachably coupled to the transmission 650 to allow for removal of the shelf 602 from the transmission 650. For example, protrusions on either side of the shelf 602 may fit into shelf hooks 656 on the transmission 650. The protrusions may be secured within the shelf hooks 656 by thumb screws 658, which, generally, at least partially prevent the shelf 602 from becoming disengaged from the transmission 650. In some aspects, the shelf 602 may be detached from the transmission 650 without decoupling the transmission 650 from the vertical rack gears 28 and vertical support members 20.

Transmission 650, generally, provides a mechanism on which the shelf 602 may traverse throughout all intermediate points between the bottom of the frame 12 and the top of the frame 12 while engaged with the two vertical rack gears 28 and two vertical support members 20 located at the back of the frame 12. More specifically, the transmission 650 may include a single worm gear drive mechanism coupled to two pinion gears 660, which engage two stationary vertical rack gears 28. Thus, the transmission 650 provides for the transfer of rotational movement from a single input location, namely, a socket 668, to at least two pinion gears 660. Transmission 650 may include two end plates 652, two slide bearings 654, two shelf hooks 656, two thumb screws 658, and two pinion gears 660. In some aspects, the transmission 650 also includes two pinion shrouds 662 and two shroud pins 664, as well as a gearbox 670 and a shaft shroud 672.

Transmission 650 further allows for a shelf angle of the shelf 602 to be adjusted. For example, the shelf 602 may be, in some aspects, a gravity feed shelf which relies on a slight downward angle to allow food or beverage products to move without assistance to the front bar 608 of the shelf 602. Each end plate 652 includes one or more shelf angle apertures 666. The shelf 602 is further coupled to the end plates 652 at one of the shelf angle apertures 666 via a shelf pin 604. In some aspects, the shelf pin 604 may be tethered to the shelf 602. Further, the shelf pin 604 may be secured through a particular shelf angle aperture 666 with a cotter pin 674 (shown in FIG. 7A). Shelf pin 604, however, may also be a pin including a ball detent and a push button release or other suitable securing device.

With particular reference to FIG. 6B, end plate 652 is shown with four shelf angle apertures 666*a-d*. If the shelf 602 is coupled to the end plate 652 (on either side) at shelf angle aperture 666*a*, the shelf 602 may form an angle substantially horizontal (i.e., substantially perpendicular to vertical). This particular aperture 666*a* may be used, for instance, when particularly heavy consumer products are placed on the shelf 602, which may cause damage or injury if they slide toward the front bar 608. Utilizing the shelf angle aperture 666*b*, however, may result in the shelf 602 having an angle approximately 85 degrees from the downward vertical direction. Shelf angle aperture 666*c* may provide the shelf 602 with an angle approximately 80 degrees from the downward vertical direction. Shelf angle aperture 666*d* may provide the shelf 602 with an angle approximately 75 degrees from the downward vertical direction.

Pinion shroud 662, as shown, covers at least a portion of the pillion gear 660 while allowing the pinion gear 660 to engage the vertical rack gear 28. Generally, the pinion shroud 662 provides protection for the pinion gear 660 to help ensure that, for example, the gear 660 is not damaged during loading and unloading of consumer product from the adjustable shelf 600. Further, the pinion shroud 662 may provide for safer operation of the pinion gear 660 as it traverses the vertical rack gear 28 so as to at least partially prevent human contact with the pinion gear 660. The pinion shroud 662 may also protect the pinion gear 660 from foreign substances, such as food or beverage product, thereby keeping the pinion gear 660 clean and operating normally. In some aspects, the pinion shroud 662 is attached to the end plate 652 with a pivotal pin 663. Additionally, in certain implementations, the pinion shroud 662 may be rotated away from the pinion gear 660 in order to, for example, replace or clean the gear 660. A shroud pin 664, when disengaged from the end plate 652, may allow the pinion shroud 662 to be rotated away from the pinion gear 660.

Figure 7A:
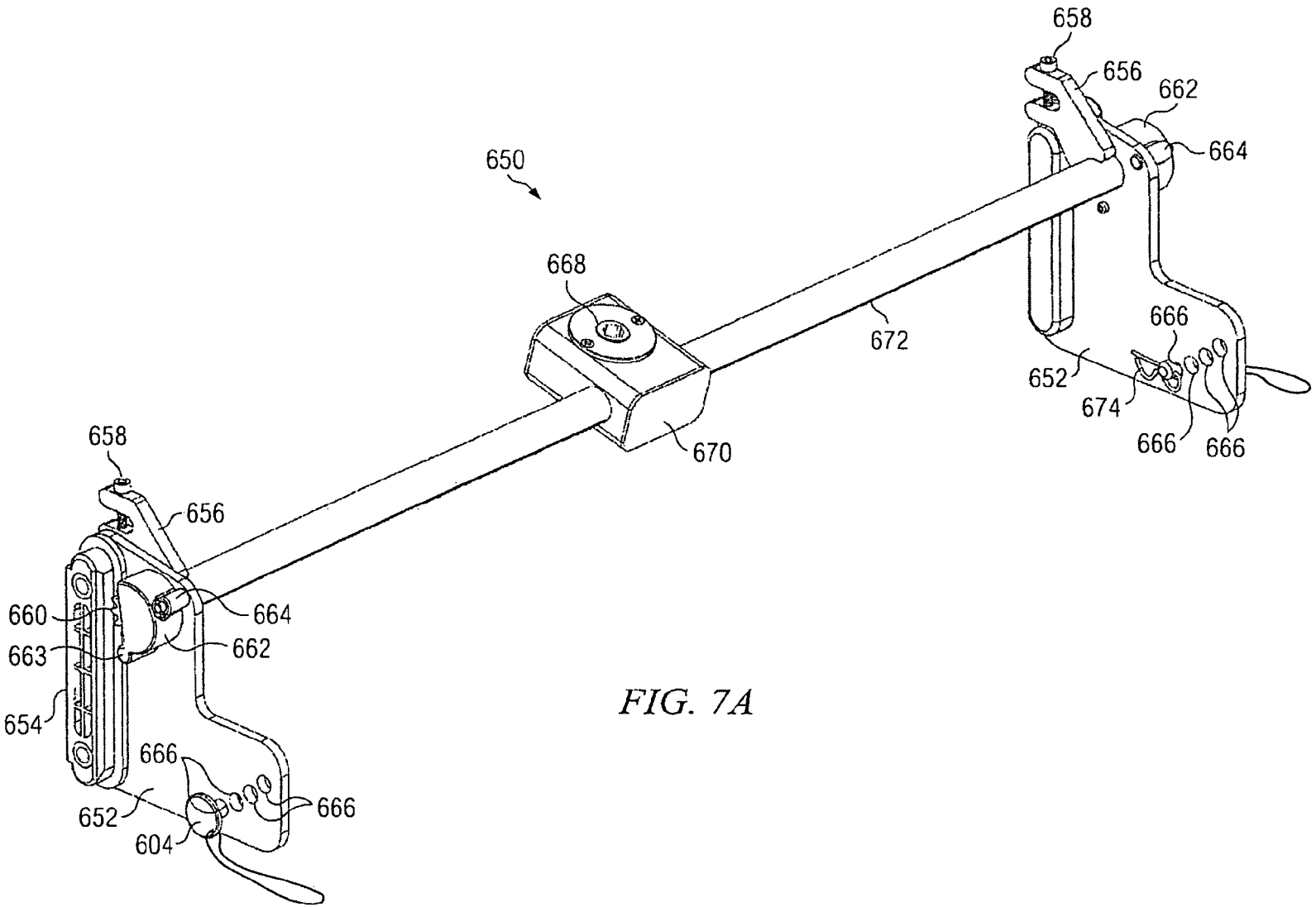
FIGS. 7A-B illustrate one implementation of a transmission module for an adjustable shelf for supporting and displaying consumer products.
Figure 7B:
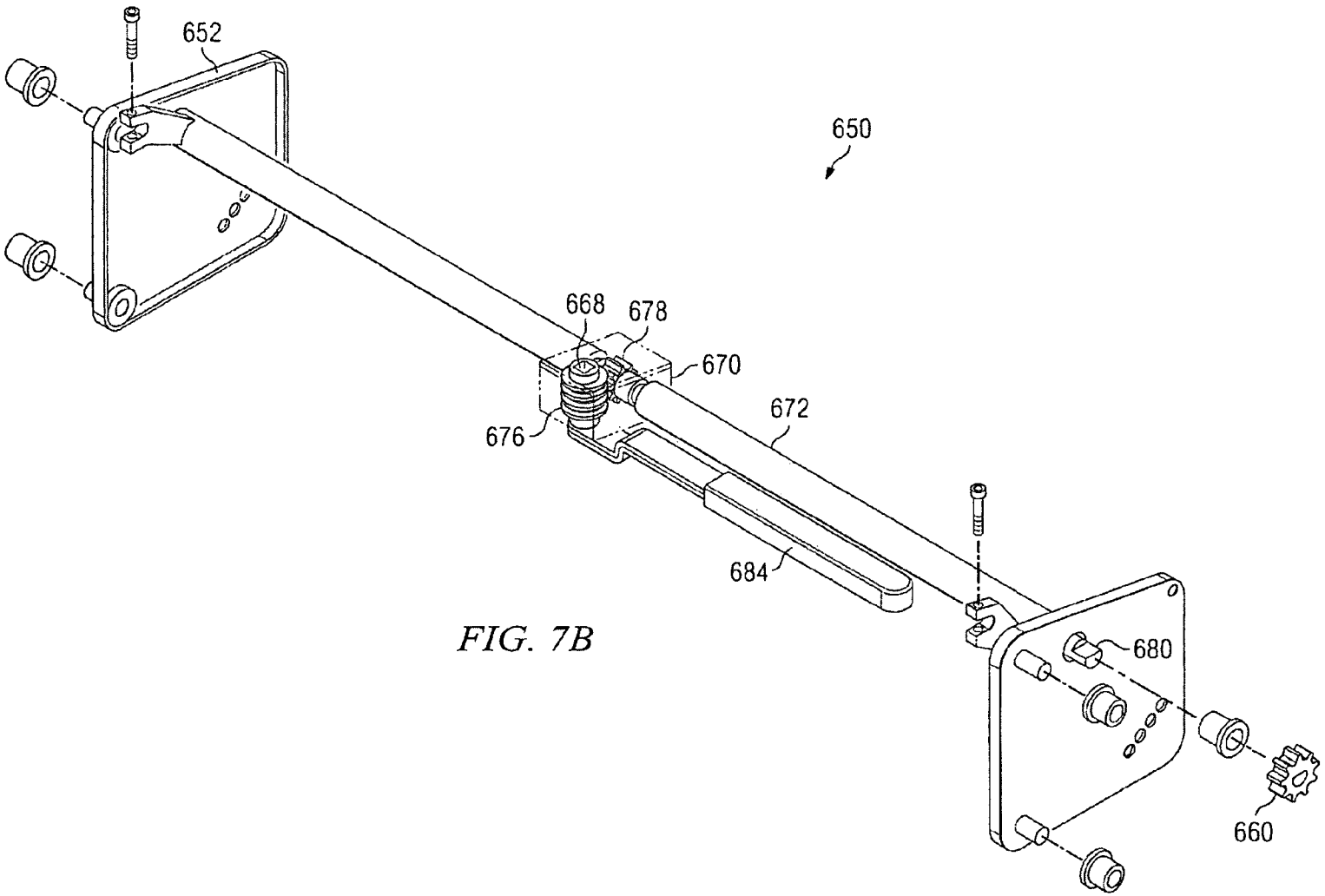

With reference to FIGS. 7A-B, the configuration of one implementation of the transmission 650 is more specifically described. The gear box 670 exposes the socket 668 which is coupled to a worm wheel 676. The worm wheel 676 is coupled to and engaged with a worm gear 678. The worm gear 678 is coupled to a single shaft 680 that extends to and through both end plates 652. Although shown as a single shaft 680, an articulated shaft with multiple joints may also be utilized as appropriate. The shaft 680 is covered by the shaft shroud 672. Typically, the worm wheel 676, worm gear 678, and shaft 680 are formed of hardened and machined steel. In some implementations, the worm gear 678 is coupled to the shaft 680 by a heat treated steel pin (not shown). The shaft 680 is coupled at each end to pinion gear 660. In some aspects, the pinion gear 660 may be made of molded plastic and be secured to the shaft 680. The transmission 650 may also include, in some aspects, an integral handle 684 coupled to the socket 668, for example coupled at an underside of the gear box 670. The integral handle 684, generally, allows a user of the system 10 to raise and lower the shelf 602 coupled to the transmission 650 by turning the handle 684 either clockwise or counterclockwise.

In some aspects, the worm gear 678 may be a self-locking worm gear, such that only rotational movement applied to the worm wheel 676 to drive the worm gear 678 may drive the shaft 680. Thus, a load of consumer product exerting a downward force on the shelf 602 coupled to the transmission 650 may not rotate the shaft 680 and worm gear 678. In more particular aspects, the worm gear 678 may have a ratio between (and including) approximately 3:1 and approximately 10:1. For instance, the worm gear 678 may be a 5:1 ratio worm gear.

Figure 8A:
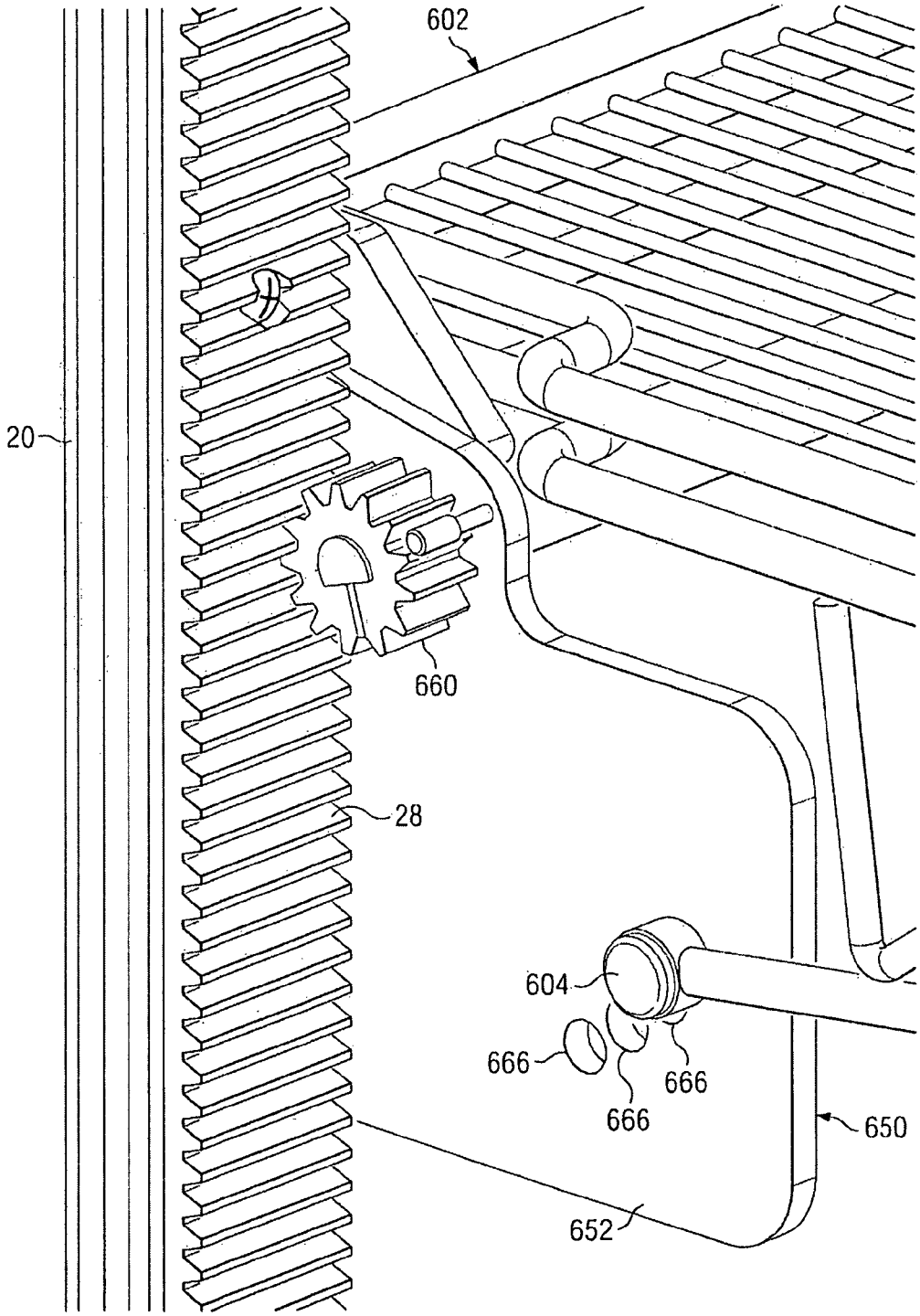
FIGS. 8A-B illustrate one implementation of an adjustable shelf coupled to a frame system for supporting and displaying consumer products.
Figure 8B:
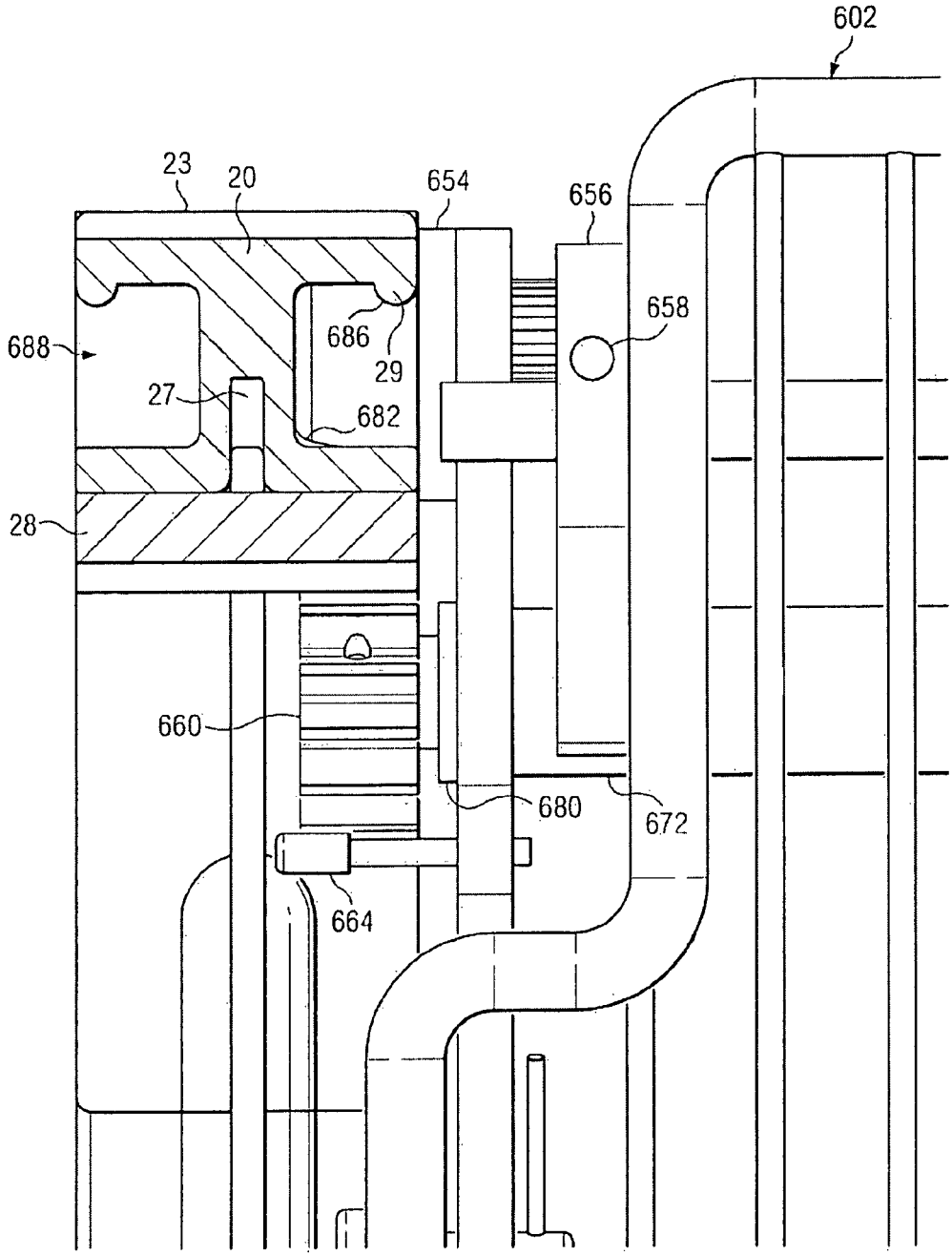

FIGS. 8A-B illustrate one implementation of an adjustable shelf coupled to a vertical rack gear and vertical support member as part of a shelving system, such as the shelving system 10, to support and display consumer products. More specifically, FIGS. 8A-B illustrate the adjustable shelf 600, including the shelf 602 coupled to the transmission 650, engaged with the vertical rack gear 28 and vertical support member 20. Turning to FIG. 8A particularly, the pinion gear 660 of the transmission 650 is shown engaging the vertical rack gear 28. Thus, operation of the worm wheel 676, which rotates the worm gear 678, which in turn rotates the shaft 680 coupled to the pinion gear 660, allows the pinion gear 660 to traverse the vertical rack gear 28 in either direction through substantially infinite increments and through substantially all intermediate locations between the top and bottom of the vertical rack gear 28. The shelf 602, therefore, may be vertically adjusted throughout all intermediate locations of the vertical rack gear 28 and vertical support member 20.

In some aspects, such as when multiple shelving systems 10 are coupled together, the vertical rack gear 28 may be engaged at a particular height by two pinion gears 660, situated side-by-side on the vertical rack gear 28. Thus, two adjustable shelves 600 may share a single vertical rack gear 28 coupled to a single vertical support member 20. A particular adjustable shelf 600, therefore, may operate independently of adjacent adjustable shelves 600 above and below, as well as adjacent adjustable shelves 600 to either side.

Turning particularly to FIG. 8B, this figure illustrates a top-down view of the adjustable shelf 600 engaged with the vertical rack gear 28, which is attached to the vertical support member 20. As shown in more detail, the vertical support member 20 may be a modified I-beam member, including the groove 27. The vertical support member 20 may also include a vertical rib 29 formed within a hollow 688 of the member 20 on both sides of the "I." The vertical rib 29, generally, may allow the slide bearing 654 to engage the vertical support member 20 and help prevent the slide bearing 654, and thus adjustable shelf 600, from disengaging from the vertical support member 20 during, for example, the loading or unloading of consumer product on the shelf 602. More specifically, the slide bearing 654 may include a chamfered edge 682 and a cutout 686. The chamfered edge 682 may allow the slide bearing 654 to rotate into the hollow 688 of the vertical support member 20 while the cutout 686 snaps around the vertical rib 29. Once engaged with the vertical support member 20, the slide bearing 654 attached to the end plate 652 may provide additional structural restraint and alignment of the pinion gear 660 with the vertical rack gear 28 to help prevent the adjustable shelf 600 from disengaging the vertical rack gear 28 and vertical support member 20. The slide bearing 654 may also provide a reduced friction contact point for the adjustable shelf 600 with the vertical support member 20 for the operation of the shelf 600.

Figure 9A:
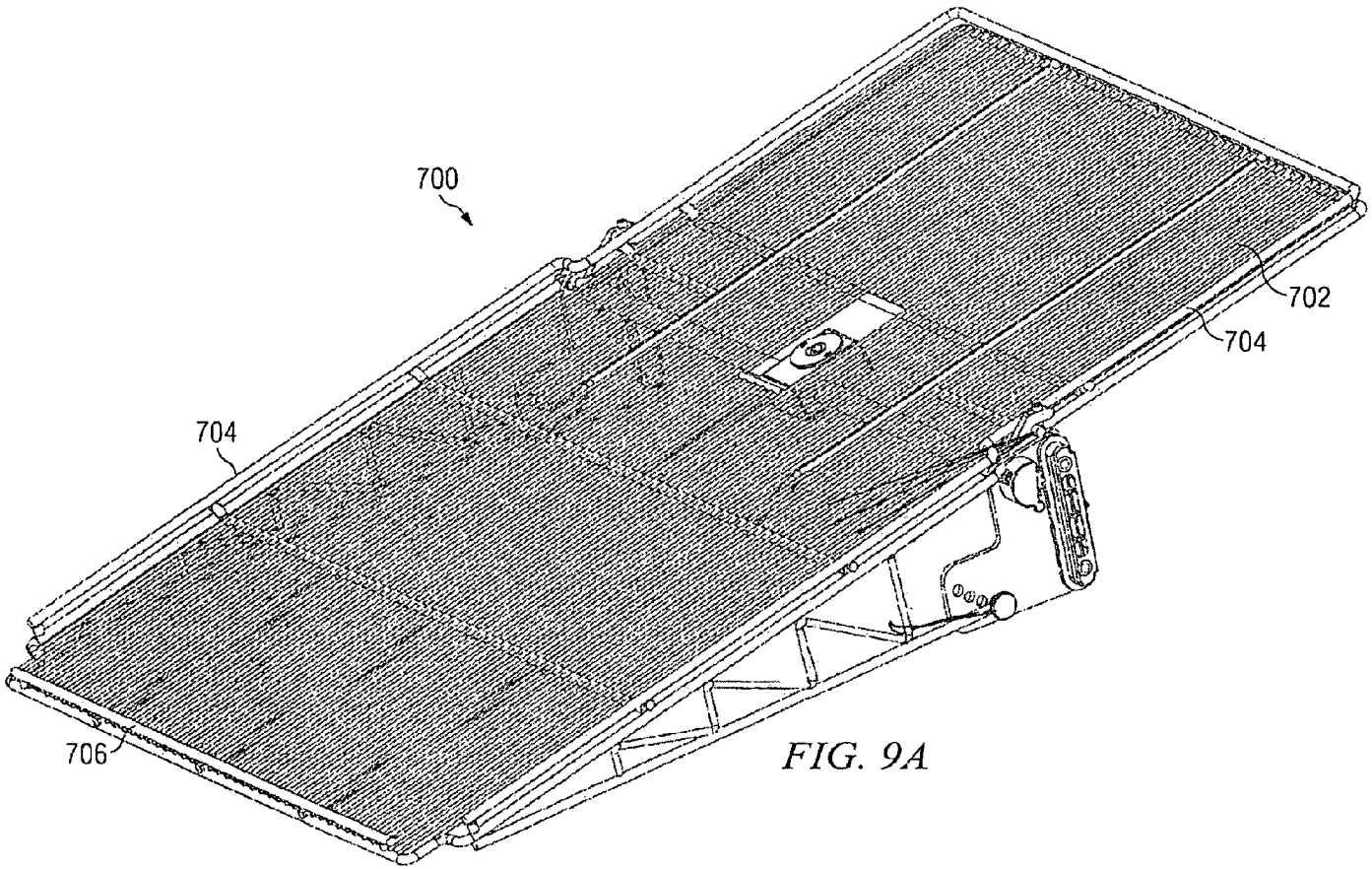
FIGS. 9A-D illustrate additional implementations of an adjustable shelf for supporting and displaying consumer products.

FIGS. 9A-D illustrate additional implementations of an adjustable shelf 700 and 750, respectively, which may be utilized in a shelving system for supporting and displaying consumer products. The adjustable shelves 700 and 750 may be used in, for example, shelving system 10 shown in FIGS. 1A-B concurrently with or in place of one or more adjustable shelves 40. Further, the adjustable shelves 700 and 750 may be utilized in any system in which the adjustable shelf 600 may be used. Turning to FIG. 9A particularly, the adjustable shelf 700 includes substantially similar components as the adjustable shelf 600 and performs substantially similar functions as the shelf 600. Adjustable shelf 700, however, includes an extended shelf 702. The extended shelf 702 may replace, for example, the shelf 602 in the adjustable shelf 600. The extended shelf 702 may allow for more consumer products, such as food and beverage containers, to be loaded onto the adjustable shelf 700. The extended shelf 702 also may include a side bar 704 and a front bar 706. The side bar 704 and front bar 706 may help prevent one or more consumer products from accidentally falling from the extended shelf 702 during, for example, loading or unloading of the shelf 702, or as the shelf 702 is adjusted up or down.

Figure 9B:
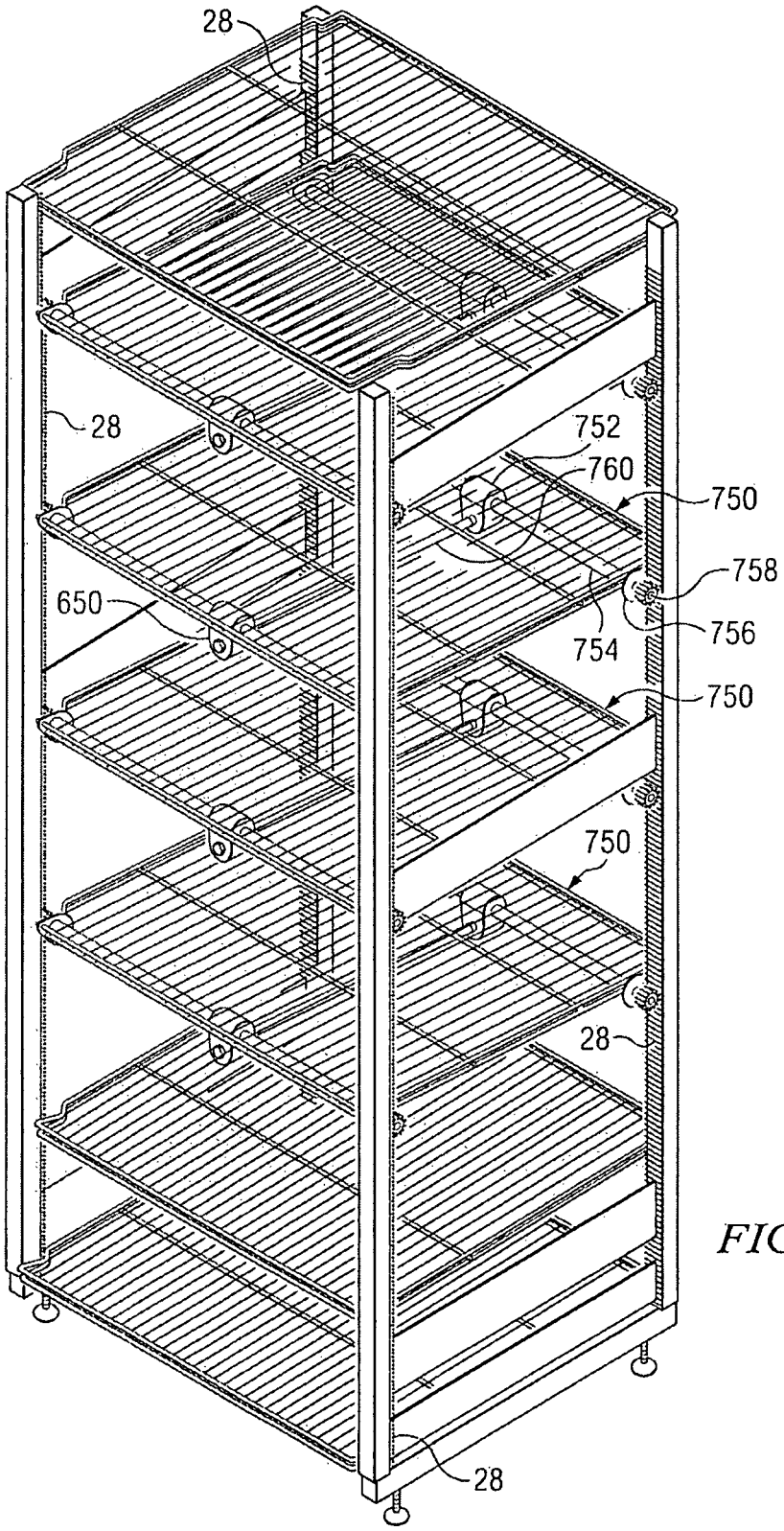

FIG. 9B illustrates the adjustable shelf 750, which may be substantially similar to the adjustable shelf 600 but include additional components. For instance, the adjustable shelf 750 includes a secondary gear box 752, a secondary shaft shroud 754 covering a secondary shaft 756, a secondary pinion gear 758 on each end of the secondary shaft 756, and a drive shaft 760. Adjustable shelf 750, generally, is a fully supported shelf rather than a cantilevered shelf and engages four vertical rack gears 28 rather than two vertical rack gears 28. Adjustable shelf 750, however, may also be vertically adjusted to substantially all intermediate positions between a top of the vertical rack gears 28 and a bottom of the vertical rack gears 28. For example, the drive shaft 760 may engage the transmission 650 and transmit rotational force to a secondary worm wheel in the secondary gear box 752. The secondary work wheel engages a secondary worm gear which drives the secondary shaft 756. The secondary shaft 756, in turn, drives the secondary pinion gears 758. Thus, the adjustable shelf 750 may vertically traverse all four vertical rack gears 28 to which it is coupled through a supply of rotational power at a single point, e.g., the socket 668 of the transmission 650.

A pitch of the adjustable shelf 750 may also be varied. For example, the drive shaft 760 may be decoupled from the transmission 650. The transmission 650 may be thus adjusted vertically to change the pitch of the shelf coupled to the transmission 650. Once a desired pitch of the adjustable shelf 750 is determined, the drive shaft 760 may be recoupled to the transmission 650. Once the drive shaft 760 is recoupled to the transmission 650, the pitch of the adjustable shelf 750 may be locked into position.

Figure 9C:
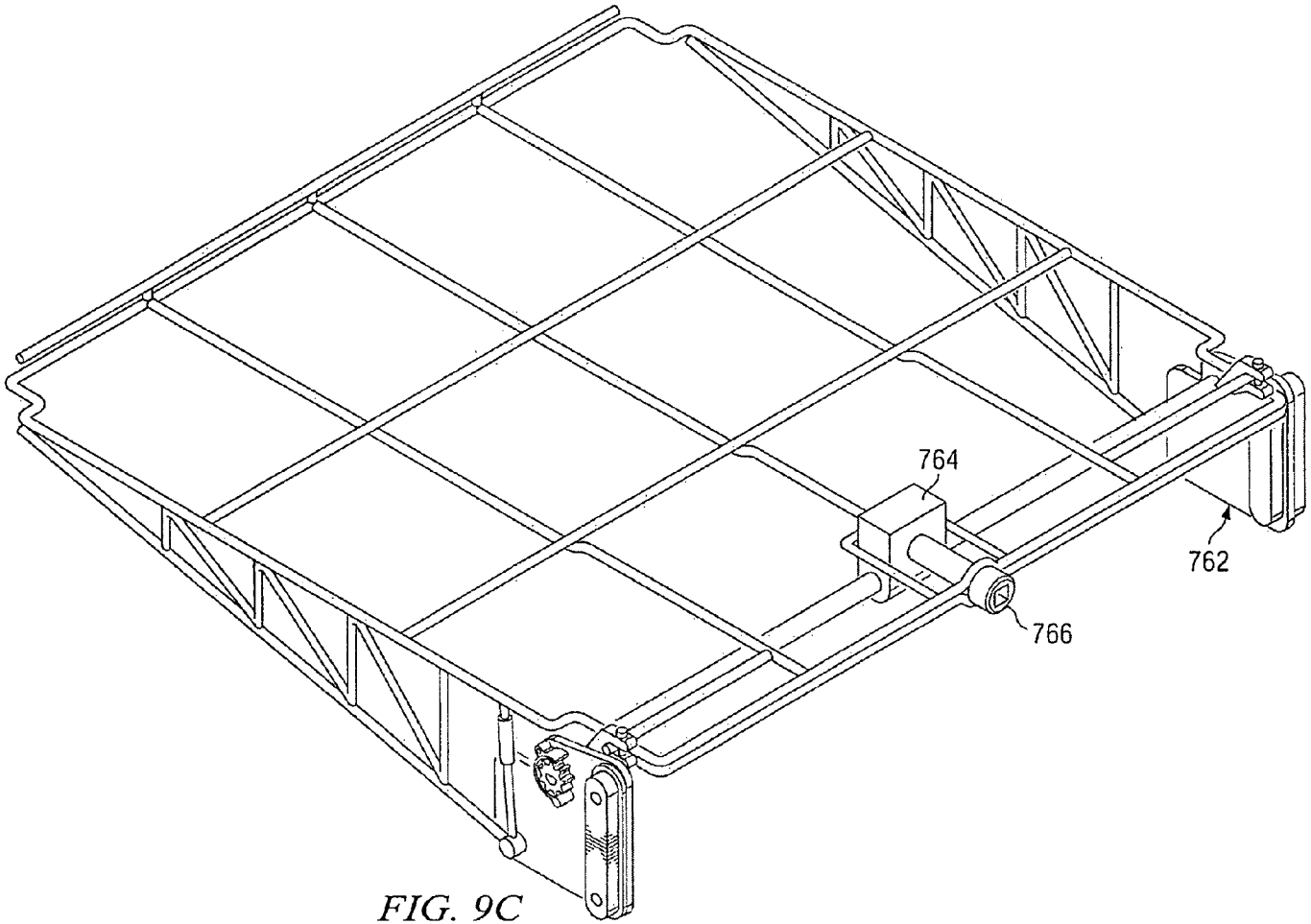
Figure 9D:
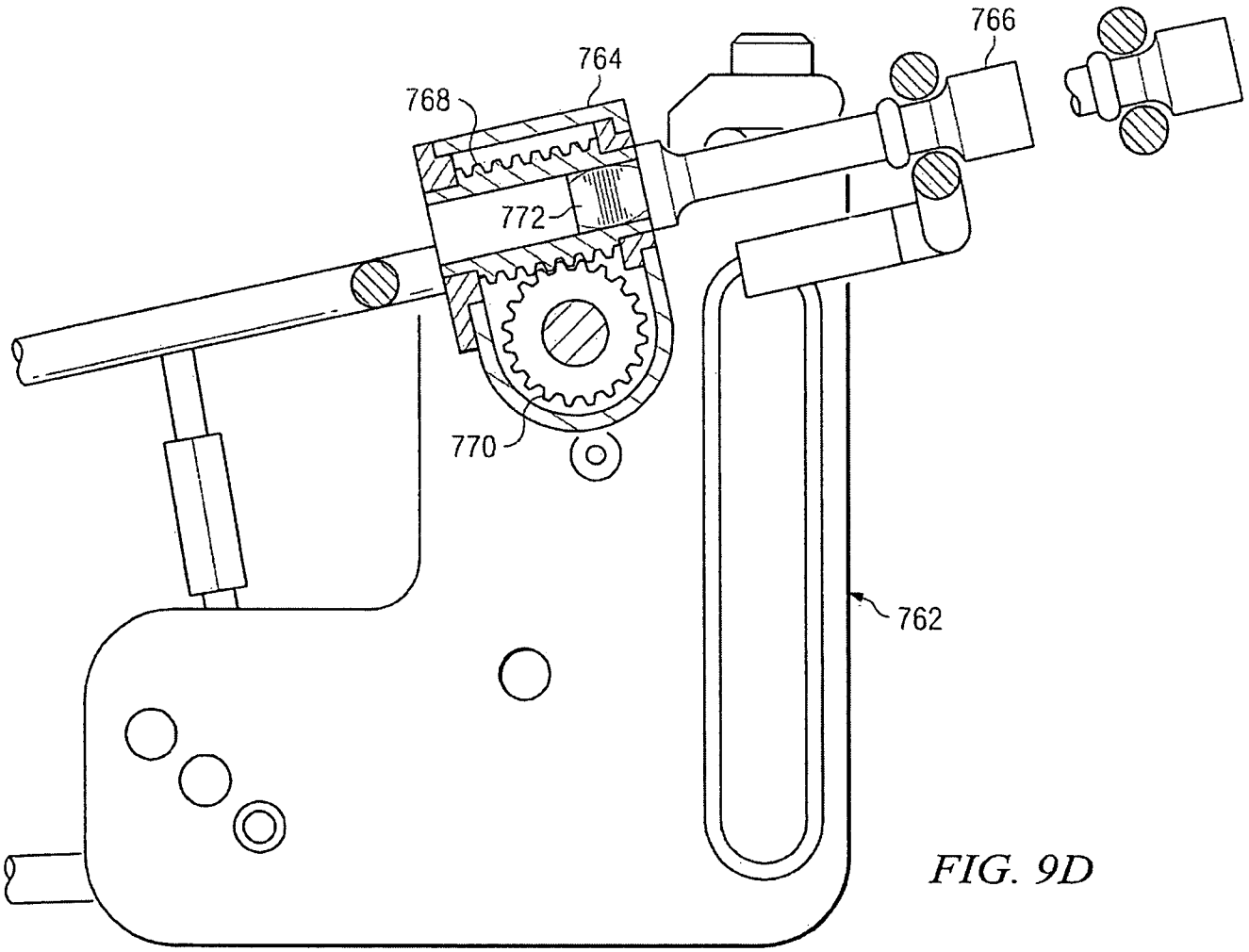

Turning to FIGS. 9C-D in particular, one implementation of a transmission 762 is illustrated. Transmission 762, for example, may be utilized in adjustable shelves 600, 700, or 750 without departing from the scope of this disclosure. Additionally, transmission 762 may include substantially similar components included in, for instance, the transmission 650 described with reference to earlier figures. In some aspects, the transmission 762 may allow for shelves of varying lengths to be coupled to the transmission 762 while still allowing for shelf adjustment from a single location without a substantial change in the design or manufacture of the shelves. For example, the transmission 762 may be utilized with adjustable shelves (e.g., adjustable shelves 600, 700 or 750) with a shelf depth of 30 inches, 35 inches, 41 inches, or other shelf depth as appropriate.

Transmission 762 includes a gear box 764 and a drive extension 766. As illustrated, the gear box 764 may be rotated approximately 90 degrees as compared to the gear box 670. In such a configuration, the gear box 764 may protrude through a shelf coupled to the transmission 762 but allow for increased clearance underneath the shelf. Rotated 90 degrees, the components of the gear box 764, namely, a worm wheel 768 and a worm gear 770, may also be rotated as compared to similar components in gear box 670. The operation and function of the worm wheel 768 and worm gear 770, however, may be substantially similar to those components in gear box 670.

The drive extension 766 may be engaged into a socket 772 of the worm wheel 768 and extended through a shelf coupled to the transmission 762. In some aspects the drive extension 766 may include a reduced diameter portion that allows for the extension 766 to be constrained by the shelf. While the drive extension 766 may be semi-permanently coupled to the gear box 764, the drive extension 766, in some aspects, may be freely removed from the gear box 764. Further, the drive extension may be of varying or adjustable lengths, so that it may be inserted into the socket 772 yet accessible through the shelf regardless of the dimensions of the shelf. In such aspects, the shelf may be adjusted (e.g., traverse in either vertical direction on one or more vertical rack gears) from a single, accessible location. Such a location may be accessible from any side of an adjustable shelf (e.g., adjustable shelves 600, 700 or 750), including, for example, a front side or a rear side. In certain implementations, the drive extension 766 may swivel using a "U" joint or a radial square.

Figure 10:
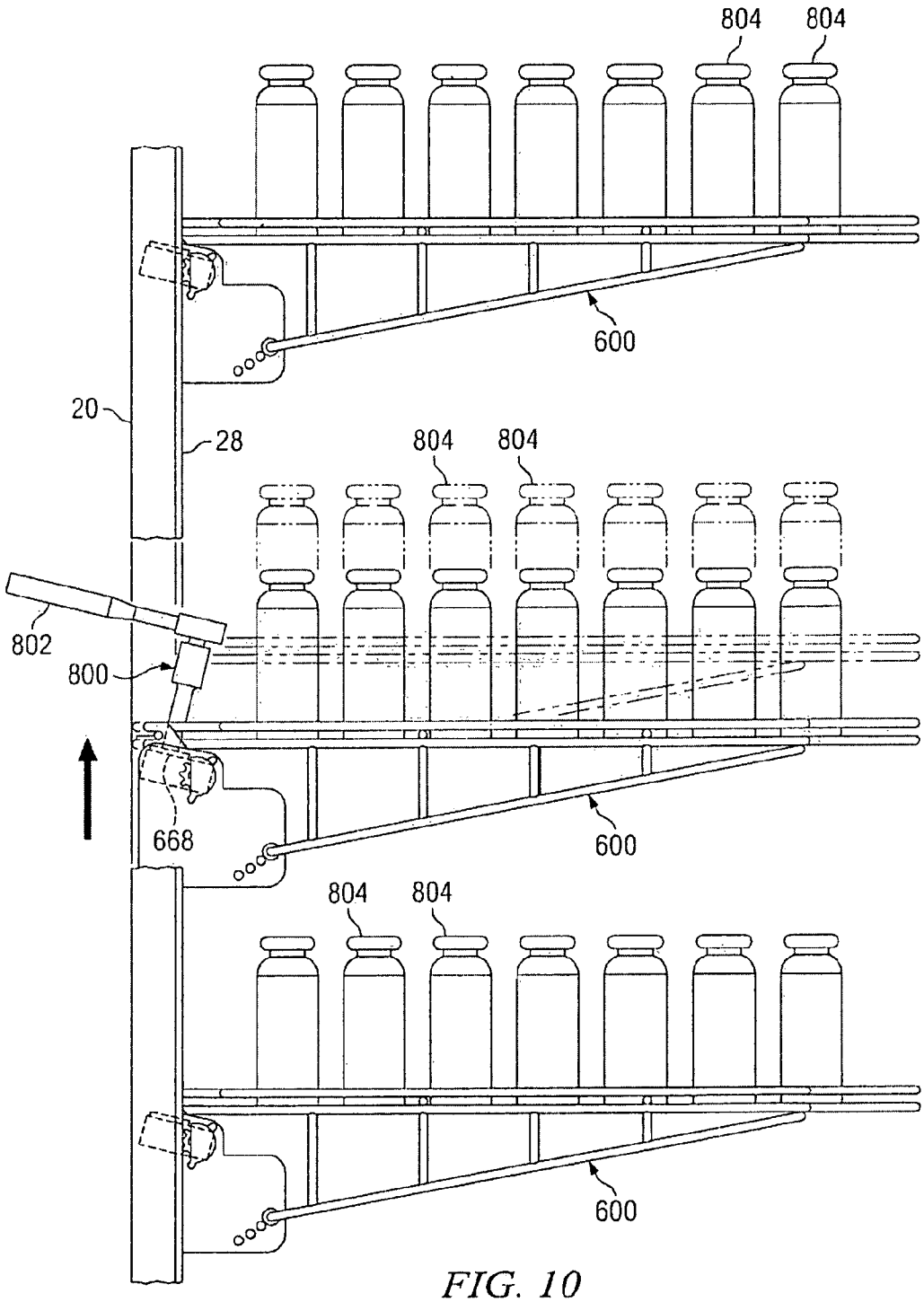
FIG. 10 illustrates one mode of operation of an adjustable shelf for supporting and displaying consumer products.

FIG. 10 illustrates one mode of operation of an adjustable shell for supporting and displaying consumer products in, for example, the shelving system 10. Generally, FIG. 10 illustrates three adjustable shelves 600 engaged to vertical rack gear 28 and vertical support member 20. Multiple beverage containers 804 are loaded onto each adjustable shelf 600. Further, a ratchet 802 is connected to the socket 668 of one of the adjustable shelves 600 through a drive key 800 (shown in more detail in FIGS. 11A-B). Ratchet 802 may be utilized, for example, in addition to or in place of the integral handle 684 shown in FIG. 7B, in order to raise or lower the adjustable shelf 600. The ratchet 802 may be a manually operated ratchet, or in some aspects, an electrically or mechanically powered ratchet. For example, an electrically powered ratchet may be coupled to the socket 668 and rotate the socket 668 in a particular direction (e.g., clockwise or counterclockwise). As shown in FIG. 10, rotational movement of the ratchet 802 while engaged to the socket 668 through the drive key 800 raises the adjustable shelf 600. Specifically, the adjustable shelf 600 may be adjusted upward independently of any movement of adjacent adjustable shelves 600. Further, the beverage containers 804 may remain on the adjustable shelf 600 during the upward movement of the adjustable shelf 600.

Figure 11A:
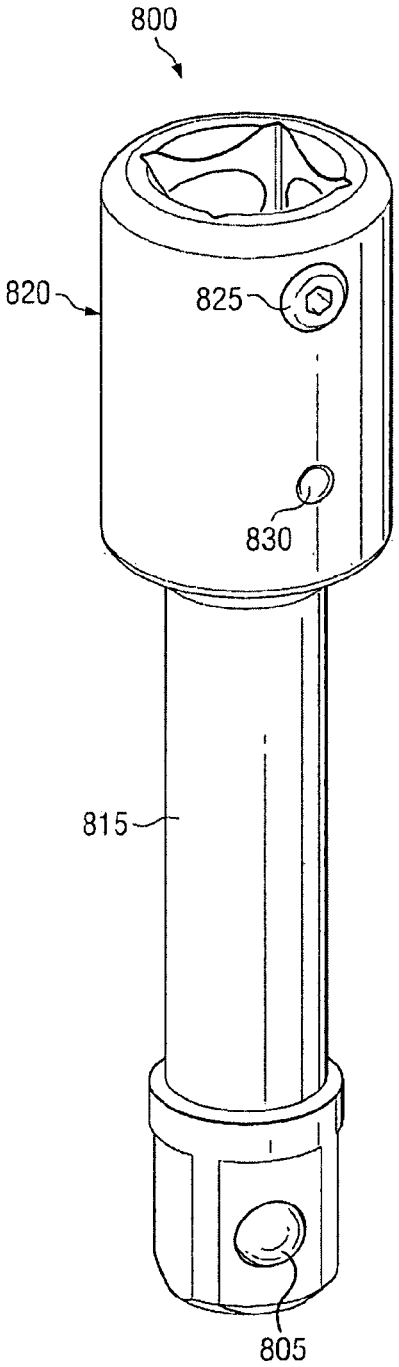
FIGS. 11A-B illustrate one implementation of a drive extension used with a transmission module according to certain aspects of the present disclosure.
Figure 11B:
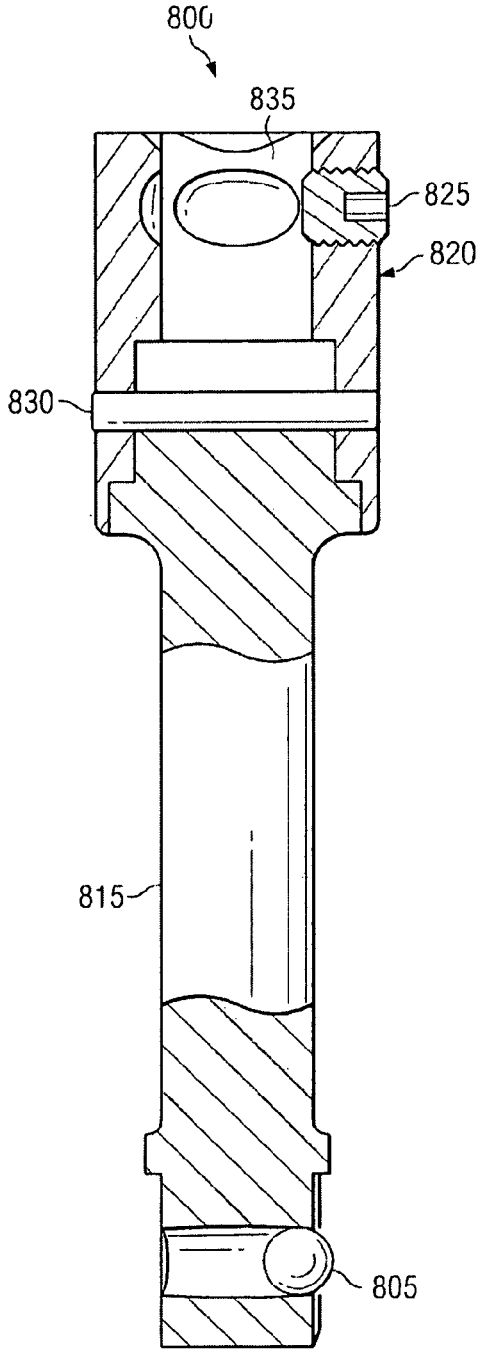

FIGS. 11A-B illustrate a drive key 800 that may be engaged with an adjustable shelf of a shelving system for supporting and displaying consumer products. The drive key 800 may be used with a standard ratchet to engage a socket (e.g. socket 668) in order to raise or lower the adjustable shelf 600. The drive key 800, as shown, includes a ball detent 805, a stem 815, and a cap 820. The ball detent 805 engages the socket 668 when the drive key 800 is inserted into the socket 668 and at least partially prevents the drive key 800 from disengaging from the socket 668 during rotation. The cap 820 includes a set screw 825, a shear pin 830, and a drive socket 835. The drive socket 835 receives a ratchet drive and the set screw 825, generally, may help prevent removal of the ratchet drive from the drive socket 835 during operation (e.g., rotation). The shear pin 830 couples the cap 820 to the stem 815. Generally, the shear pin 830 is designed to fail at a predetermined load less than that which may cause a transmission of the adjustable shelf to fail, such as the transmission 650. The drive key 800, therefore, may protect the transmission 650 from failure due to excessive rotational force placed on it during operation. Once the shear pin 830 fails, the drive key 800 may be repaired or replaced.

Figure 12A:
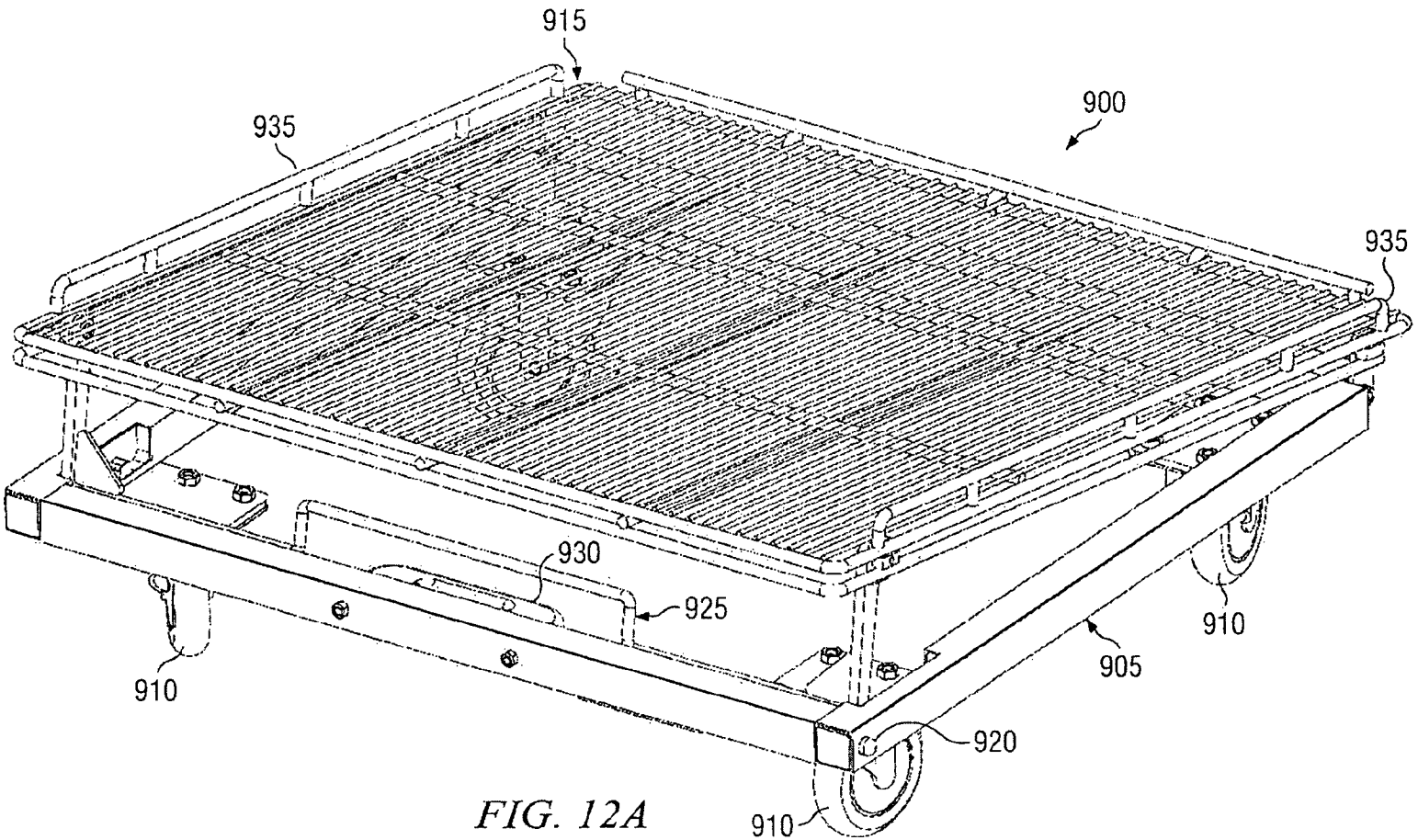
FIGS. 12A-C illustrate one implementation of a mobile shelf utilized in a shelving system for supporting and displaying consumer products.
Figure 12B:
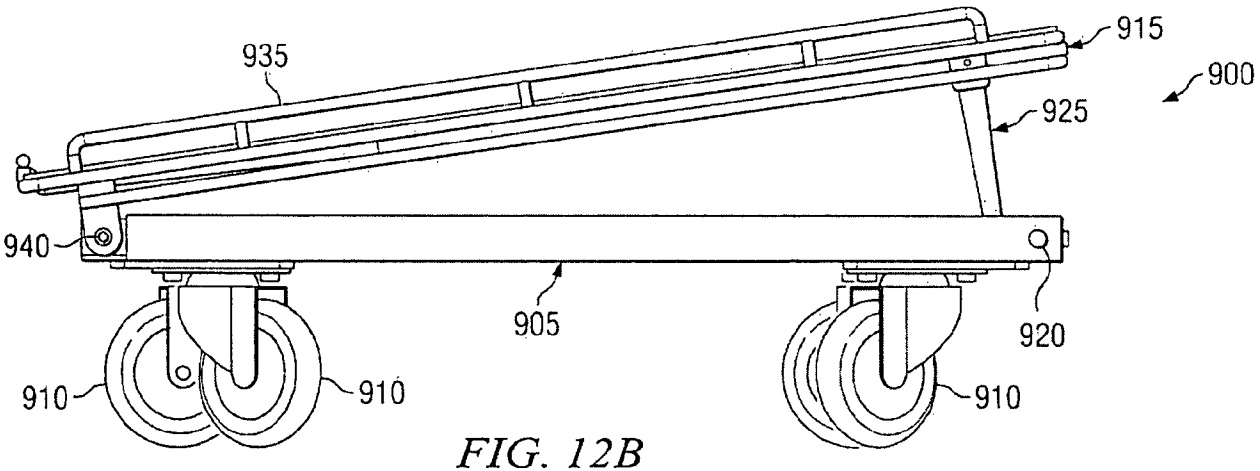
Figure 12C:
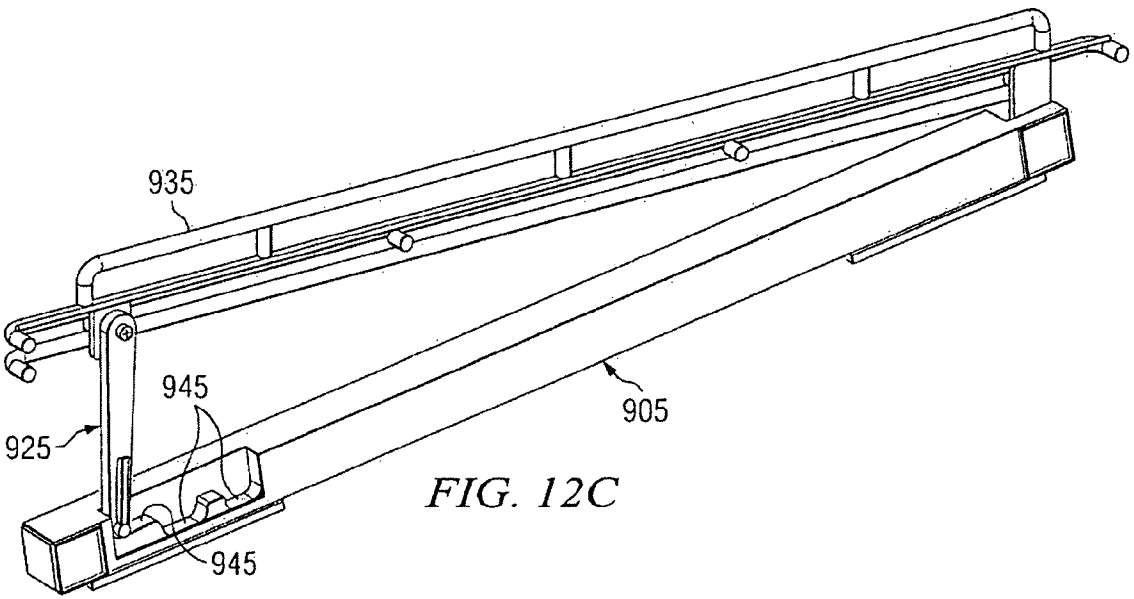

FIGS. 12A-C illustrate one implementation of a docking shelf 900, which may be utilized in a shelving system for supporting and displaying consumer products. For example, the docking shelf 900 may be used in the shelving system 10 and may be, in some aspects, substantially similar to docking shelf 70 shown in FIGS. 1A-B. For instance, the docking shelf 900 includes a shelf frame 905, one or more wheels 910, a shelf 915 including one or more side bars 935, a position bar 925, and a release handle 930. The docking shelf 900 further includes one or more position seats 945.

The shelf frame 905 is, typically, substantially square and formed of tubular steel or aluminum structural members. The structural members of the shelf frame may be welded or otherwise mechanically attached, as appropriate. Further, in some aspects, the shelf frame 905 is painted or powder-coated to improve corrosion resistance and cleanability. Generally, the shelf 915 is coupled to the shelf frame 905 at one or more pivot pins 940, thus allowing the shelf 915 to rotate from a horizontal orientation through a variety of angled positions. In some aspects, the shelf 915 may be a wire shelf and angled on a downward slope toward a front side of the docking shelf 900 at the pivot pins 940 to allow the consumer products (e.g., food or beverage containers), to slide toward the front for easier removal. The docking shelf 900 further includes one or more latch pins 920 located on the sides of the shelf 900, which allow the shelf 900 to be secured within the shelving system 10. Generally, the latch pins 920 may be compressed as the docking shelf 900 is inserted into the shelving system 10 until each engages a corresponding slot, e.g., slot 235 in U-base component 200. Release handle 930 is coupled to the latch pins 920 through the shelf frame 905. Upon compression of the release handle 930, the latch pins 920 may be retracted and disengaged from the slots 235, thus allowing the removal of the docking shelf 900 from the shelving system 10.

The position bar 925 includes a substantially horizontal portion and one or more lever arms pivotally coupled to the shelf 915. In some aspects, as illustrated in FIG. 12A, the position bar 925 may include a handle portion allowing a user of the docking shelf 900 to more easily grasp and rotate the bar 925. Turning to FIG. 12C particularly, one or both side pieces of the shelf frame 905 may include one or more position seats 945. The position seats 945 each provide a notch in which the lever arms of the position bar 925 may be set. As the position bar 925 may rotate in order to set in the various position seats 945, an angle of the shelf 915 may be adjusted by utilizing the different seats 945. For example, by placing the position bar 925 in the position seat 945 furthest from the front of the docking shelf 900, the shelf 915 may achieve approximately a 3½ inch vertical drop from the back of the shelf 915 to the front of the shelf 915. However, different or additional shelf angles may be achieved with different position seats 945.

A number of implementations have been described. Nevertheless, it will be understood that various modifications may be made. Accordingly, other implementations are within the scope of the following claims.

What is claimed is:

1. An adjustable shelving system for supporting consumer products, comprising:

a support frame comprising:

a base structure;

a first vertical support member coupled to the base structure, the first vertical support member comprising a first vertical rack gear;

a second vertical support member coupled to the base structure adjacent the first vertical support member, the second vertical support member comprising a second vertical rack gear; and a third vertical support member coupled to the base structure adjacent the second vertical support member, the third vertical support member comprising a third vertical rack gear, each of the first, second, and third vertical rack gear comprising a base end and a top end;

a first adjustable shelf assembly comprising:

a first transmission module coupled to the first and second vertical rack gears, the first transmission module adapted to traverse the first and second vertical rack gears; and a first shelf coupled to the first transmission module;

a second adjustable shelf assembly comprising:

a second transmission module coupled to the first and second vertical rack gears, the second transmission module adapted to traverse the first and second vertical rack gears independently of the first transmission module at substantially infinite intermediate positions between the base ends and the top ends of the first and second vertical rack gears; and a second shelf coupled to the second transmission module; and a third adjustable shelf assembly, the third adjustable shelf assembly comprising:

a third transmission module coupled to the second and third vertical rack gears, the third transmission module adapted to traverse the second vertical rack gear independently of the first and the second transmission modules at all intermediate positions between the base end and the top end of the second vertical rack gear; and a third shelf coupled to the third transmission module.

2. The system of claim 1, wherein the second transmission module is adapted to decouple from the first and second vertical rack gears independently of the first transmission module.

3. The system of claim 1, wherein a topside of at least one of the first shelf, the second shelf, or the third shelf is adapted to be disposed at an angle of less than 90 degrees from substantially downward vertical.

4. The system of claim 1, wherein the first shelf is adapted to vertically traverse the support frame using a single point of control through substantially infinite increments between a first end of the support frame and a second end of the support frame without unloading one or more consumer products from a topside of the shelf.

5. The system of claim 4, wherein the single point of control comprises a ratchet socket.

6. The system of claim 5, further comprising a ratchet handle detachably coupled to the ratchet socket.

7. The system of claim 5, wherein the first shelf comprises a front edge and a back edge, the ratchet socket accessible through the first shelf substantially proximate to the back edge.

8. The system of claim 7, further comprising a drive extension coupled to the ratchet socket and longitudinally extended proximate to the back edge.

9. The system of claim 8, wherein the first transmission module is adapted to fail at a first load, and the drive extension further comprises:

a stem;

a detent coupled to the stem, the detent adapted to secure the stem within the ratchet socket; and a cap coupled to the stem and adapted to receive a ratchet drive, the cap comprising a shear pin, the shear pin adapted to fail at a second load, the second load less than the first load.

10. The system of claim 1, wherein the adjustable shelving system is adapted to support consumer products located in a walk-in cooler.

11. The system of claim 1, wherein the first shelf is a cantilevered adjustable shelf.

12. The system of claim 1, wherein the first transmission module comprises:

a worm wheel coupled to a ratchet socket;

a worm gear engaged to the worm wheel and coupled to a back axle shaft;

a first pinion gear coupled to a first end of the back axle shaft; and a second pinion gear coupled to a second end of the back axle shaft.

13. The system of claim 12, wherein the first pinion gear is adapted to engage the first vertical rack gear and the second pinion gear adapted to engage the second vertical rack gear.

14. The system of claim 12, wherein the first shelf is adapted to support a maximum load of approximately 200 pounds, the worm gear comprising a self-locking worm gear adapted to maintain the first and second pinion gears engaged with the first and second vertical rack gears at a static position at the maximum load.

15. The system of claim 12, wherein the worm gear comprises a worm gear with a ratio between and including about 3:1 to about 10:1.

16. The system of claim 1, wherein the first vertical support member comprises a vertical rib, the first adjustable shelf assembly further comprising a slide bearing that comprises a grooved edge and a chamfered edge, the grooved edge rotatably engageable with the vertical rib.

* * * * *

UNITED STATES PATENT AND TRADEMARK OFFICE

CERTIFICATE OF CORRECTION

PATENT NO. : 8,556,093 B2
APPLICATION NO. : 12/031471
DATED : October 15, 2013
INVENTOR(S) : Raymond E. Davis and Clifton Glenn Hampton It is certified that error appears in the above-identified patent and that said Letters Patent is hereby corrected as shown below:

In the Specification

Column 2, line 16, delete “consume” and insert -- consumer --, therefor.

Column 9, line 34, delete “pillion” and insert -- pinion --, therefor.

Column 12, line 34, delete “shell” and insert -- shelf --, therefor.

Signed and Sealed this
Fifteenth Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,556,093 B2
APPLICATION NO. : 12/031471
DATED : October 15, 2013
INVENTOR(S) : Davis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 876 days.

Signed and Sealed this
Seventh Day of April, 2015

Michelle K. Lee

Michelle K. Lee
*Director of the United States Patent and Trademark Office*